US009651879B2

(12) United States Patent
Maruyama et al.

(10) Patent No.: US 9,651,879 B2
(45) **Date of Patent: *May 16, 2017**

(54) ELECTROPHOTOGRAPHIC PHOTOSENSITIVE MEMBER, METHOD OF PRODUCING THE ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Akihiro Maruyama, Mishima (JP); Harunobu Ogaki, Suntou-gun (JP); Yuki Yamamoto, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/656,272

(22) Filed: Mar. 12, 2015

(65) Prior Publication Data

US 2016/0238957 A1 Aug. 18, 2016

(30) Foreign Application Priority Data

Mar. 26, 2014 (JP) ..... 2014-064088
Feb. 13, 2015 (JP) ..... 2015-026689

(51) Int. Cl.
*G03G 5/05* (2006.01)
*G03G 5/07* (2006.01)

(52) U.S. Cl.
CPC ..... *G03G 5/078* (2013.01); *G03G 5/056* (2013.01); *G03G 5/0564* (2013.01); *G03G 5/0578* (2013.01); *G03G 5/0596* (2013.01)

(58) Field of Classification Search
CPC .... G03G 5/056; G03G 5/0564; G03G 5/0578; G03G 5/0596
(Continued)

(56) References Cited

U.S. PATENT DOCUMENTS 6,416,915 B1 7/2002 Kikuchi et al.
7,563,553 B2 7/2009 Kikuchi et al.
(Continued)

FOREIGN PATENT DOCUMENTS

JP 06019167 A * 1/1994
JP 2007-79555 A 3/2007
(Continued)

OTHER PUBLICATIONS

English language machine translation of JP 06-019167 (Jan. 1994).*
(Continued)

*Primary Examiner* — Christopher Rodee
(74) *Attorney, Agent, or Firm* — Fitzpatrick Cella Harper and Scinto

(57) ABSTRACT

A charge-transporting layer as the surface layer of an electrophotographic photosensitive member contains a charge-transporting substance, and contains, as resins, a resin A having specific structural units and a polycarbonate resin D having specific structural units. The charge-transporting layer has, in a matrix containing the charge-transporting substance and the polycarbonate resin D, domains each containing the resin A.

8 Claims, 2 Drawing Sheets

(58) Field of Classification Search
USPC ..... 430/59.6, 96
See application file for complete search history.

(56) References Cited

U.S. PATENT DOCUMENTS

| | | | | |
|---|---|---|---|---|
| 7,875,410 | B2 * | 1/2011 | Ogaki | G03G 5/056 430/58.8 |
| 8,753,789 | B2 | 6/2014 | Ogaki et al. | |
| 8,940,465 | B2 | 1/2015 | Sekido et al. | |
| 9,034,545 | B2 | 5/2015 | Maruyama et al. | |
| 9,235,144 | B2 * | 1/2016 | Yamamoto | G03G 5/0607 |
| 9,274,442 | B2 * | 3/2016 | Sato | G03G 5/04 |
| 2004/0043312 | A1 | 3/2004 | Kikuchi et al. | |
| 2012/0301182 | A1 * | 11/2012 | Anezaki | G03G 5/056 399/111 |
| 2014/0023961 | A1 | 1/2014 | Okuda et al. | |
| 2014/0377701 | A1 | 12/2014 | Okuda et al. | |
| 2014/0377703 | A1 | 12/2014 | Ogaki et al. | |

FOREIGN PATENT DOCUMENTS

| | | | | |
|---|---|---|---|---|
| JP | 2007-199688 | A | | 8/2007 |
| JP | 2011095649 | A | * | 5/2011 |
| JP | 2012-42628 | A | | 3/2012 |
| JP | 2012-83737 | A | | 4/2012 |
| JP | 4975181 | B2 | | 7/2012 |
| JP | 5089815 | B2 | | 12/2012 |
| JP | 2014-29500 | A | | 2/2014 |
| WO | 2010/008095 | A1 | | 1/2010 |

OTHER PUBLICATIONS

English language machine translation of JP 2011-095649 (May 2011).*

U.S. Appl. No. 14/656,574, filed Mar. 12, 2015. Inventor: Akihiro Maruyama, et al.

U.S. Appl. No. 14/662,228, filed Mar. 18, 2015. Inventor: Taichi Sato, et al.

* cited by examiner

ELECTROPHOTOGRAPHIC PHOTOSENSITIVE MEMBER, METHOD OF PRODUCING THE ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, a method of producing the electrophotographic photosensitive member, and a process cartridge and an electrophotographic apparatus each including the electrophotographic photosensitive member.

Description of the Related Art

An electrophotographic photosensitive member containing an organic photoconductive substance (sometimes referred to as "charge-generating substance") has been vigorously developed as an electrophotographic photosensitive member to be mounted on an electrophotographic apparatus. The electrophotographic photosensitive member generally includes a support and a photosensitive layer containing a charge-generating substance on the support. In addition, the photosensitive layer is generally of a laminate type (forward layer type) obtained by laminating a charge-generating layer and a charge-transporting layer in the stated order from the support side.

In an electrophotographic process, a variety of members such as a developer, a charging member, a cleaning blade, paper, and a transferring member (hereinafter sometimes referred to as "contact member") have contact with the surface of the electrophotographic photosensitive member. Therefore, characteristics required of the electrophotographic photosensitive member include a reduction in image deterioration due to a contact stress with such contact member or the like. In particular, in recent years, the electrophotographic photosensitive member has been desired to be further improved in sustainability of an effect of reducing the image deterioration due to the contact stress and in suppression of a potential variation at the time of repeated use along with improvement of durability of the electrophotographic photosensitive member.

To relax the contact stress sustainably and to suppress the potential variation at the time of the repeated use of the electrophotographic photosensitive member, International Publication No. WO2010/008095, Japanese Patent No. 4975181, and Japanese Patent No. 5089815 each propose a method of forming a matrix-domain structure in a surface layer using a siloxane resin having a siloxane structure incorporated into its molecular chain. In particular, it is disclosed that the use of a polyester resin having incorporated therein a specific siloxane structure can achieve both the sustainable relaxation of the contact stress and the suppression of the potential variation at the time of the repeated use of the electrophotographic photosensitive member.

Each of the electrophotographic photosensitive members disclosed in the literatures can achieve both the sustainable relaxation of the contact stress and the suppression of the potential variation at the time of the repeated use. However, additional improvements in the electrophotographic photosensitive members have been desired in order that an increase in speed of an electrophotographic apparatus and an increase in number of printed sheets may be achieved. The inventors of the present invention have advanced studies, and as a result, have found that the additional improvements can be achieved by incorporating a specific polycarbonate resin upon formation of the matrix-domain structure.

SUMMARY OF THE INVENTION

An object of the present invention is to provide an electrophotographic photosensitive member that achieves both sustainable relaxation of a contact stress and the suppression of a potential variation at the time of its repeated use, and a method of producing the electrophotographic photosensitive member. Another object of the present invention is to provide a process cartridge and an electrophotographic apparatus each including the electrophotographic photosensitive member.

The present invention relates to an electrophotographic photosensitive member including: a support; a charge-generating layer on the support; and a charge-transporting layer on the charge-generating layer, which contains a charge-transporting substance and a resin; in which: the charge-transporting layer is a surface layer of the electrophotographic photosensitive member, the charge-transporting layer includes a matrix-domain structure having: a domain which includes a resin A including: a structural unit represented by one of the following formulae (A-1) and (A-2); and a structural unit represented by the following formula (B); and a matrix which includes a charge-transporting substance and a polycarbonate resin D including: a structural unit represented by the following formula (D); and a structural unit represented by the following formula (E); a content of the structural unit represented by one of the formulae (A-1) and (A-2) in the resin A is from 5% by mass to 25% by mass based on a total mass of the resin A; a content of the structural unit represented by the formula (B) in the resin A is from 25% by mass to 95% by mass based on the total mass of the resin A; a content of the structural unit represented by the formula (D) in the polycarbonate resin D is from 10% by mass to 60% by mass based on a total mass of the polycarbonate resin D; and a content of the structural unit represented by the formula (E) in the polycarbonate resin D is from 40% by mass to 90% by mass based on the total mass of the polycarbonate resin D;

(A-1)

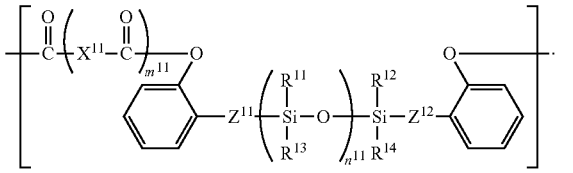

in the formula (A-1): $m^1$ represents 0 or 1; when $m^{11}$ represents 1, $X^{11}$ represents an o-phenylene group, a m-phenylene group, a p-phenylene group, a bivalent group having two p-phenylene groups bonded with a methylene group, or a bivalent group having two p-phenylene groups bonded with an oxygen atom; $Z^{11}$ and $Z^{12}$ each independently represent an alkylene group having 1 to 4 carbon atoms; $R^{11}$ to $R^{14}$ each independently represent an alkyl group having 1 to 4 carbon atoms, or a phenyl group; and $n^{11}$ represents a number of repetitions of a structure within parentheses, and an average of $n^{11}$ in the formula (A-1) ranges from 10 to 150;

(A-2)

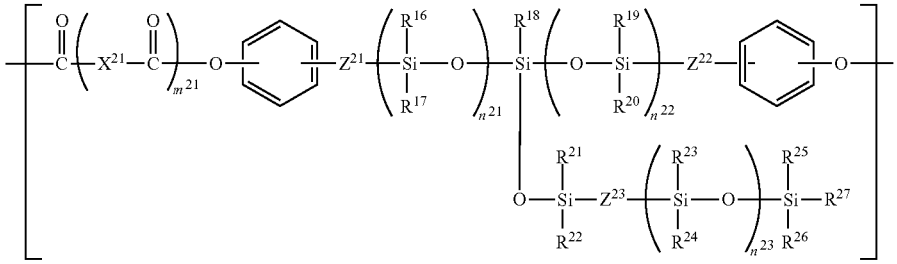

in the formula (A-2): $m^{21}$ represents 0 or 1; when $m^{21}$ represents 1, $X^{21}$ represents an o-phenylene group, a m-phenylene group, a p-phenylene group, a bivalent group having two p-phenylene groups bonded with a methylene group, or a bivalent group having two p-phenylene groups bonded with an oxygen atom; $Z^{21}$ to $Z^{23}$ each independently represent an alkylene group having 1 to 4 carbon atoms; $R^{16}$ to $R^{27}$ each independently represent an alkyl group having 1 to 4 carbon atoms, or a phenyl group; and $n^{21}$, $n^{22}$, and $n^{23}$ each independently represent a number of repetitions of a structure within parentheses, an average of $n^{21}$ and an average of $n^{22}$ in the formula (A-2) each range from 1 to 10, and an average of $n^{23}$ in the formula (A-2) ranges from 10 to 200;

(B)

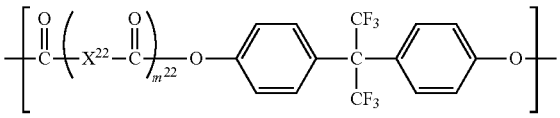

in the formula (B): $m^{22}$ represents 0 or 1; when $m^{22}$ represents 1, and $X^{22}$ represents an o-phenylene group, a m-phenylene group, a p-phenylene group, a bivalent group having two p-phenylene groups bonded with a methylene group, or a bivalent group having two p-phenylene groups bonded with an oxygen atom;

(D)

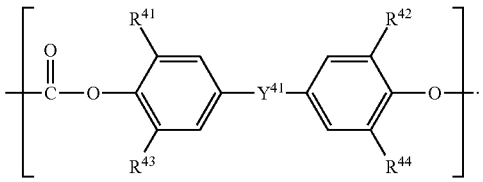

in the formula (D): $Y^{41}$ represents an oxygen atom or a sulfur atom; and $R^{41}$ to $R^{44}$ each independently represent a hydrogen atom or a methyl group;

(E)

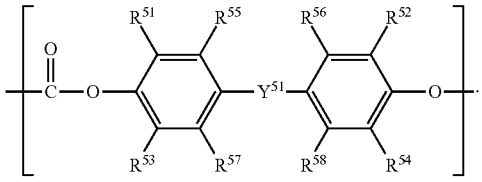

in the formula (E): $Y^{51}$ represents a single bond, a methylene group, an ethylidene group, a propylidene group, a cyclohexylidene group, a phenylethylidene group, or a phenylmethylene group; and $R^{51}$ to $R^{58}$ each independently represent a hydrogen atom or a methyl group.

The present invention also relates to a process cartridge, including: the electrophotographic photosensitive member; and at least one unit selected from the group consisting of a charging unit, a developing unit, a transfer unit, and a cleaning unit, the member and the unit being supported integrally, in which the process cartridge is removably mounted onto an electrophotographic apparatus body.

The present invention also relates to an electrophotographic apparatus, including: the electrophotographic photosensitive member; a charging unit; an exposing unit; a developing unit; and a transfer unit.

The present invention also relates to a method of producing an electrophotographic photosensitive member including: a support; a charge-generating layer on the support; and a charge-transporting layer on the charge-generating layer, the charge-transporting layer being a surface layer of the electrophotographic photosensitive member, the method including: preparing an application liquid for a charge-transporting layer, the application liquid containing: a resin A including: a structural unit represented by one of the formulae (A-1) and (A-2); and a structural unit represented by the formula (B); a polycarbonate resin D including: a structural unit represented by the formula (D); and a structural unit represented by the formula (E); and a charge-transporting substance; and forming a coating film of the application liquid for a charge-transporting layer, followed by drying the coating film, to thereby form the charge-transporting layer, a content of the structural unit represented by one of the formulae (A-1) and (A-2) in the resin A being from 5% by mass to 25% by mass based on a total mass of the resin A, a content of the structural unit represented by the formula (B) in the resin A being from 25% by mass to 95% by mass based on the total mass of the resin A, a content of the structural unit represented by the formula (D) in the polycarbonate resin D being from 10% by mass to 60% by mass based on a total mass of the polycarbonate resin D, a content of the structural unit represented by the formula (E) in the polycarbonate resin D being from 40% by mass to 90% by mass based on the total mass of the polycarbonate resin D.

According to one embodiment of the present invention, it is possible to provide the excellent electrophotographic photosensitive member that achieves both sustainable relaxation of a contact stress and the suppression of a potential variation at the time of its repeated use. According to other embodiments of the present invention, it is possible to provide the process cartridge and the electrophotographic apparatus each including the electrophotographic photosensitive member.

Further features of the present invention will become apparent from the following description of exemplary embodiments with reference to the attached drawings.

DESCRIPTION OF THE EMBODIMENTS

Figure 1:
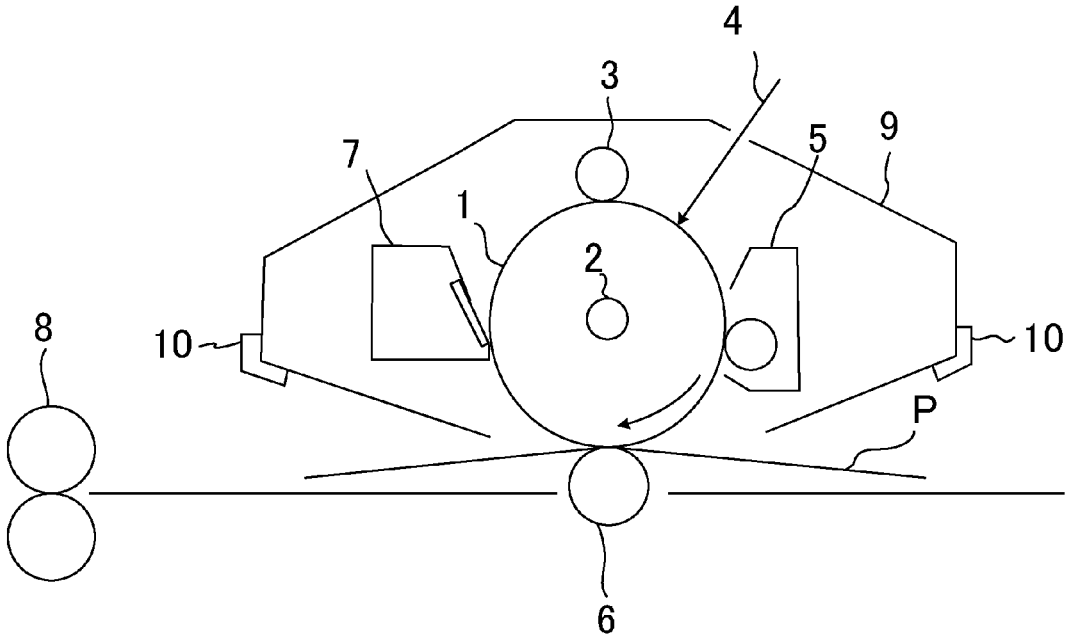
FIG. 1 is a view illustrating an example of the schematic construction of an electrophotographic apparatus including a process cartridge including an electrophotographic photosensitive member of the present invention.

Preferred embodiments of the present invention will now be described in detail in accordance with the accompanying drawings.

In the present invention, the charge-transporting layer of an electrophotographic photosensitive member has a matrix-domain structure including a matrix and a domain.

The domain contains a resin A. The resin A has a structural unit represented by the formula (A-1) or the formula (A-2), and a structural unit represented by the formula (B).

The matrix contains: a polycarbonate resin D having a structural unit represented by the formula (D) and a structural unit represented by the following formula (E); and a charge-transporting substance.

The resin A is described below. The resin A has a structural unit represented by the formula (A-1) or the formula (A-2), and a structural unit represented by the formula (B).

(A-1)

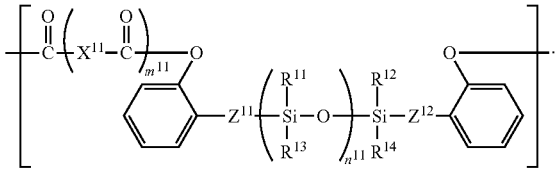

$m^{11}$ in the formula (A-1) represents 0 or 1. When $m^{11}$ represents 1, $X^{11}$ represents an o-phenylene group, a m-phenylene group, a p-phenylene group, a bivalent group having two p-phenylene groups bonded with a methylene group, or a bivalent group having two p-phenylene groups bonded with an oxygen atom. Of those, a m-phenylene group, a p-phenylene group, or a bivalent group having two p-phenylene groups bonded with an oxygen atom is preferred in terms of the relaxation of a contact stress.

$Z^{11}$ and $Z^{12}$ in the formula (A-1) each independently represent an alkylene group having 1 to 4 carbon atoms such as a methylene group, an ethylene group, a propylene group, or a butylene group. Of those, a propylene group is preferred in terms of the relaxation of the contact stress.

$R^1$ to $R^{14}$ in the formula (A-1) each independently represent an alkyl group having 1 to 4 carbon atoms such as a methyl group, an ethyl group, a propyl group, a butyl group, or a phenyl group. Of those, a methyl group is preferred in terms of the relaxation of the contact stress.

$n^{11}$ in the formula (A-1) represents the number of repetitions of a structure within parentheses and the average of $n^{11}$ in the formula (A-1) ranges from 10 to 150. When the average of $n^{11}$ ranges from 10 to 150, the domain containing the resin A are uniformly formed in the matrix containing the charge-transporting substance and the resin D. The average of $n^{11}$ particularly preferably ranges from 40 to 80.

Table 1 below shows examples of the structural unit represented by the formula (A-1).

TABLE 1

| Formula (A-1) | $m^{11}$ | $X^{11}$ | $R^{11}$ to $R^{14}$ | $Z^{11}$, $Z^{12}$ | Average of $n^{11}$ |
|---|---|---|---|---|---|
| A-1-1 | 1 | o-Phenylene | Methyl | Propylene | 40 |
| A-1-2 | 1 | m-Phenylene | Methyl | Propylene | 40 |
| A-1-3 | 1 | p-Phenylene | Methyl | Propylene | 40 |
| A-1-4 | 1 | m-Phenylene | Methyl | Propylene | 80 |
| A-1-5 | 1 | p-Phenylene | Methyl | Propylene | 80 |
| A-1-6 | 1 | 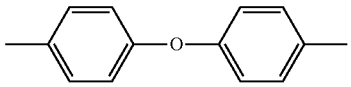 | Methyl | Propylene | 40 |
| A-1-7 | 1 | 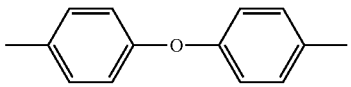 | Methyl | Propylene | 80 |
| A-1-8 | 1 | m-Phenylene | Methyl | Propylene | 10 |
| A-1-9 | 1 | p-Phenylene | Methyl | Propylene | 100 |
| A-1-10 | 1 | p-Phenylene | Ethyl | Methylene | 150 |
| A-1-11 | 1 | 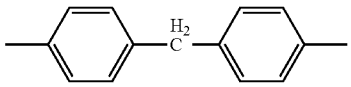 | Methyl | Propylene | 40 |
| A-1-12 | 1 | p-Phenylene | Phenyl | Propylene | 60 |

TABLE 1-continued

| Formula (A-1) | $m^{11}$ | $X^{11}$ | $R^{11}$ to $R^{14}$ | $Z^{11}$, $Z^{12}$ | Average of $n^{11}$ |
|---|---|---|---|---|---|
| A-1-13 | 1 | 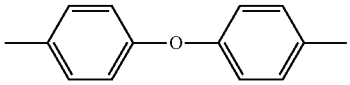 | Methyl | Ethylene | 100 |
| A-1-14 | 1 | 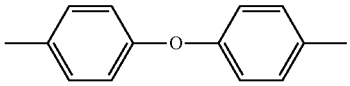 | Propyl | Butylene | 20 |
| A-1-15 | 1 | m-Phenylene | Butyl | Methylene | 10 |
| A-1-16 | 1 | m-Phenylene | Methyl | Ethylene | 100 |
| A-1-17 | 1 | p-Phenylene | Methyl | Butylene | 40 |
| A-1-18 | 1 | p-Phenylene | Methyl | Ethylene | 80 |
| A-1-19 | 1 | p-Phenylene | Methyl | Propylene | 150 |
| A-1-20 | 0 | — | Methyl | Propylene | 40 |
| A-1-21 | 0 | — | Methyl | Propylene | 80 |
| A-1-22 | 0 | — | Methyl | Ethylene | 100 |
| A-1-23 | 0 | — | Ethyl | Butylene | 10 |
| A-1-24 | 0 | — | Butyl | Methylene | 150 |
| A-1-25 | 0 | — | Phenyl | Ethylene | 20 |

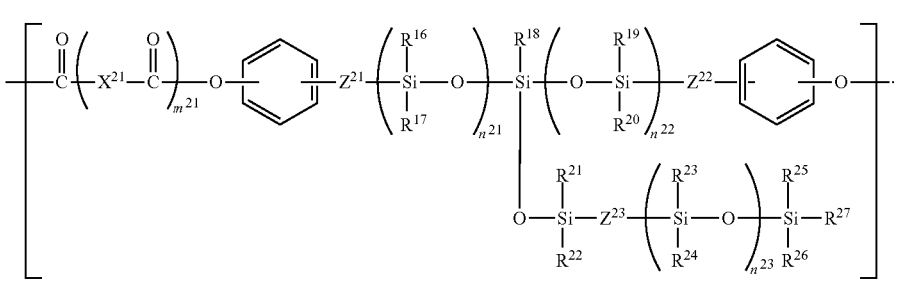

(A-2)

$m^{21}$ in the formula (A-2) represents 0 or 1. When $m^{21}$ represents 1, $X^{21}$ represents an o-phenylene group, a m-phenylene group, a p-phenylene group, a bivalent group having two p-phenylene groups bonded with a methylene group, or a bivalent group having two p-phenylene groups bonded with an oxygen atom. Of those, a m-phenylene group, a p-phenylene group, or a bivalent group having two p-phenylene groups bonded with an oxygen atom is preferred in terms of the relaxation of the contact stress.

$Z^{21}$ to $Z^{23}$ in the formula (A-2) each independently represent an alkylene group having 1 to 4 carbon atoms such as a methylene group, an ethylene group, a propylene group, or a butylene group. $Z^{21}$ and $Z^{22}$ each preferably represent a propylene group and $Z^{23}$ preferably represents an ethylene group in terms of the relaxation of the contact stress.

$R^{16}$ to $R^{27}$ in the formula (A-2) each independently represent an alkyl group having 1 to 4 carbon atoms such as a methyl group, an ethyl group, a propyl group, a butyl group, or a phenyl group. Of those, a methyl group is preferably used as each of $R^{16}$ to $R^{27}$ in terms of the relaxation of the contact stress.

$n^{21}$, $n^{22}$, and $n^{23}$ in the formula (A-2) each independently represent the number of repetitions of a structure within parentheses, and the average of each of $n^{21}$ and $n^{22}$ in the formula (A-2) ranges from 1 to 10, and the average of $n^{23}$ ranges from 10 to 200. When the average of each of $n^{21}$ and $n^{22}$ ranges from 1 to 10, and the average of $n^{23}$ ranges from 10 to 200, the domain containing the resin A are uniformly formed in the matrix containing the charge-transporting substance and the polycarbonate resin D. The average of $n^{21}$ and the average of $n^{22}$ each preferably ranges from 1 to 5, and the average of $n^{23}$ preferably ranges from 40 to 120. Table 2 below shows examples of the structural unit represented by the formula (A-2).

TABLE 2

| Formula (A-2) | $m^{21}$ | $X^{21}$ | $R^{16}$ to $R^{27}$ | $Z^{21}$, $Z^{22}$ | $Z^{23}$ | $n^{21}$, $n^{22}$ | Average of $n^{23}$ |
|---|---|---|---|---|---|---|---|
| A-2-1 | 1 | o-Phenylene | Methyl | Propylene | Ethylene | 1 | 40 |
| A-2-2 | 1 | m-Phenylene | Methyl | Propylene | Ethylene | 1 | 40 |
| A-2-3 | 1 | p-Phenylene | Methyl | Propylene | Ethylene | 1 | 40 |
| A-2-4 | 1 | m-Phenylene | Methyl | Propylene | Ethylene | 1 | 80 |
| A-2-5 | 1 | p-Phenylene | Methyl | Propylene | Ethylene | 1 | 80 |

TABLE 2-continued

| Formula (A-2) | $m^{21}$ | $X^{21}$ | $R^{16}$ to $R^{27}$ | $Z^{21}$, $Z^{22}$ | $Z^{23}$ | $n^{21}$, $n^{22}$ | Average of $n^{23}$ |
|---|---|---|---|---|---|---|---|
| A-2-6 | 1 | 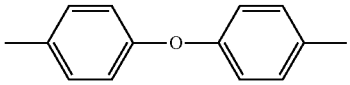 | Methyl | Propylene | Ethylene | 1 | 40 |
| A-2-7 | 1 | 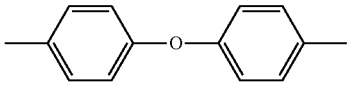 | Methyl | Propylene | Ethylene | 1 | 80 |
| A-2-8 | 1 | m-Phenylene | Methyl | Propylene | Ethylene | 5 | 10 |
| A-2-9 | 1 | p-Phenylene | Methyl | Propylene | Ethylene | 10 | 100 |
| A-2-10 | 1 | p-Phenylene | Ethyl | Methylene | Ethylene | 5 | 150 |
| A-2-11 | 1 | 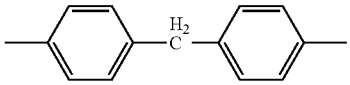 | Methyl | Propylene | Butylene | 5 | 40 |
| A-2-12 | 1 | p-Phenylene | Phenyl | Propylene | Methylene | 10 | 60 |
| A-2-13 | 1 | 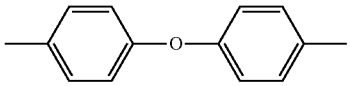 | Methyl | Ethylene | Propylene | 5 | 100 |
| A-2-14 | 1 | 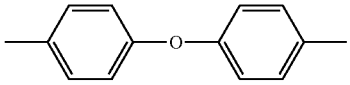 | Propyl | Butylene | Butylene | 1 | 20 |
| A-2-15 | 1 | m-Phenylene | Butyl | Methylene | Butylene | 10 | 10 |
| A-2-16 | 1 | m-Phenylene | Methyl | Ethylene | Propylene | 1 | 100 |
| A-2-17 | 1 | p-Phenylene | Methyl | Butylene | Ethylene | 5 | 40 |
| A-2-18 | 1 | p-Phenylene | Methyl | Ethylene | Methylene | 1 | 80 |
| A-2-19 | 1 | p-Phenylene | Methyl | Propylene | Methylene | 5 | 150 |
| A-2-20 | 0 | — | Methyl | Propylene | Ethylene | 1 | 40 |
| A-2-21 | 0 | — | Methyl | Propylene | Methylene | 1 | 80 |
| A-2-22 | 0 | — | Methyl | Ethylene | Propylene | 1 | 100 |
| A-2-23 | 0 | — | Ethyl | Butylene | Butylene | 5 | 10 |
| A-2-24 | 0 | — | Butyl | Methylene | Methylene | 10 | 150 |
| A-2-25 | 0 | — | Phenyl | Ethylene | Ethylene | 10 | 20 |

With regard to the structural units represented by the formula (A-1) and the formula (A-2), out of the structural units, a structural unit represented by the formula (A-1-2), (A-1-3), (A-1-4), (A-1-5), (A-1-6), (A-1-7), (A-1-20), (A-1-21), (A-2-2), (A-2-3), (A-2-4), (A-2-5), (A-2-6), (A-2-7), (A-2-20), or (A-2-21) is preferred.

(B)

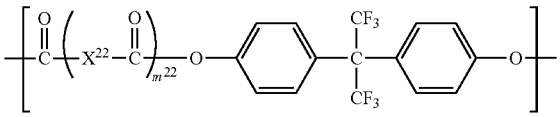

$m^{22}$ in the formula (B) represents 0 or 1. When $m^{22}$ represents 1, $X^{22}$ represents an o-phenylene group, a m-phenylene group, a p-phenylene group, a bivalent group having two p-phenylene groups bonded with a methylene group, or a bivalent group having two p-phenylene groups bonded with an oxygen atom. Examples of the structural unit represented by the formula (B) are shown below.

(B-1)

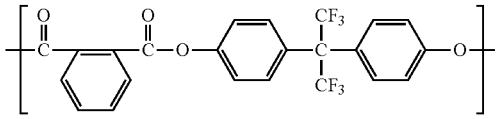

(B-2)

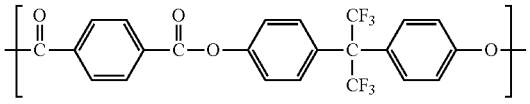

-continued (B-3)

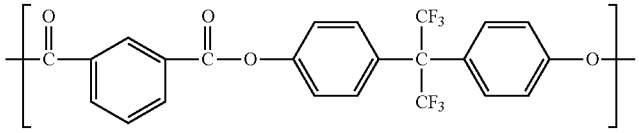

(B-4)

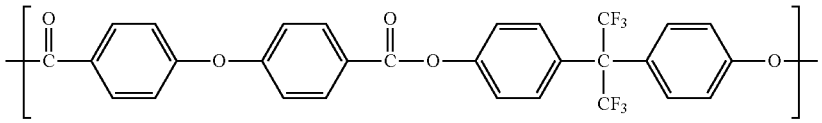

(B-5)

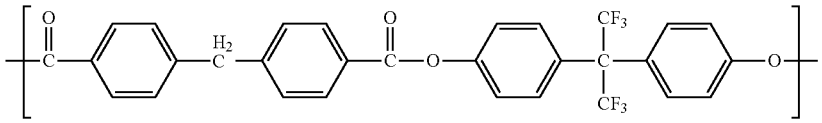

(B-6)

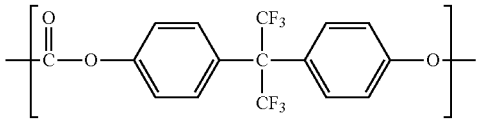

Of those, a structural unit represented by the formula (B-2), (B-3), (B-4), or (B-6) is preferred.

In addition, the resin A can further have a structural unit represented by the following formula (C).

(C)

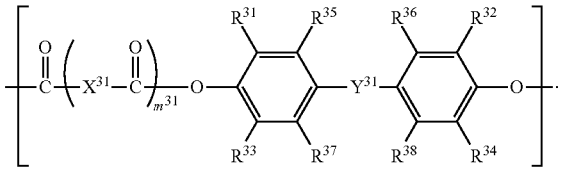

$m^{31}$ in the formula (C) represents 0 or 1. When $m^{31}$ represents 1, $X^{31}$ represents an o-phenylene group, a m-phenylene group, a p-phenylene group, a bivalent group having two p-phenylene groups bonded with a methylene group, or a bivalent group having two p-phenylene groups bonded with an oxygen atom.

$Y^{31}$ in the formula (C) represents an oxygen atom or a sulfur atom, and $R^{31}$ to $R^{38}$ each independently represent a hydrogen atom or a methyl group. Table 3 below shows examples of the structural unit represented by the formula (C).

TABLE 3

| Formula (C) | $m^{31}$ | $X^{31}$ | $Y^{31}$ | $R^{31}$, $R^{32}$ | $R^{33}$, $R^{34}$ | $R^{35}$ to $R^{38}$ |
|---|---|---|---|---|---|---|
| C-1 | 1 | o-Phenylene | O | H | H | H |
| C-2 | 1 | m-Phenylene | O | H | H | H |
| C-3 | 1 | p-Phenylene | O | H | H | H |
| C-4 | 1 | 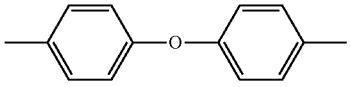 | O | H | H | H |
| C-5 | 1 | 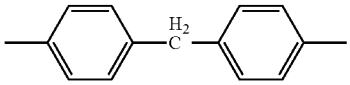 | O | H | H | H |
| C-6 | 1 | o-Phenylene | O | Methyl | H | H |
| C-7 | 1 | m-Phenylene | O | Methyl | H | H |
| C-8 | 1 | p-Phenylene | O | Methyl | H | H |
| C-9 | 1 | 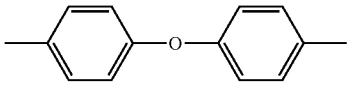 | O | Methyl | H | H |
| C-10 | 1 | 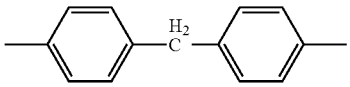 | O | Methyl | H | H |

TABLE 3-continued

| Formula (C) | $m^{31}$ | $X^{31}$ | $Y^{31}$ | $R^{31}$, $R^{32}$ | $R^{33}$, $R^{34}$ | $R^{35}$ to $R^{38}$ |
|---|---|---|---|---|---|---|
| C-11 | 1 | o-Phenylene | O | Methyl | Methyl | H |
| C-12 | 1 | m-Phenylene | O | Methyl | Methyl | H |
| C-13 | 1 | p-Phenylene | O | Methyl | Methyl | H |
| C-14 | 1 | 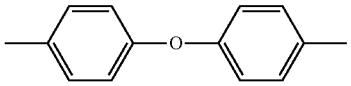 | O | Methyl | Methyl | H |
| C-15 | 1 | 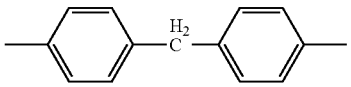 | O | Methyl | Methyl | H |
| C-16 | 1 | o-Phenylene | S | H | H | H |
| C-17 | 1 | m-Phenylene | S | Methyl | H | H |
| C-18 | 1 | p-Phenylene | S | H | H | H |
| C-19 | 1 | 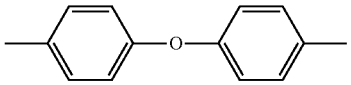 | S | Methyl | H | H |
| C-20 | 1 | 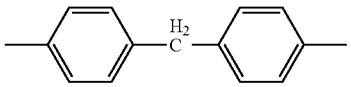 | S | H | H | H |
| C-21 | 0 | — | O | H | H | H |
| C-22 | 0 | — | O | Methyl | H | H |
| C-23 | 0 | — | O | Methyl | Methyl | H |
| C-24 | 0 | — | S | H | H | H |
| C-25 | 0 | — | S | Methyl | H | H |
| C-26 | 0 | — | S | Methyl | Methyl | H |

Of those, a structural unit represented by the formula (C-2), (C-3), (C-4), (C-21), or (C-22) is preferred.

The resin A can further have the structural unit represented by the formula (C) and a structural unit represented by the following formula (F).

(F)

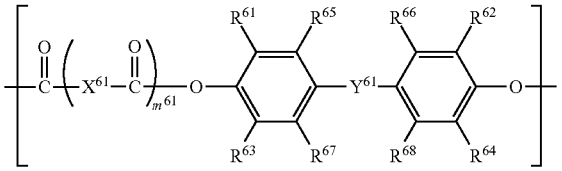

$m^{61}$ in the formula (F) represents 0 or 1. When $m^{61}$ represents 1, $X^{61}$ represents an o-phenylene group, a m-phenylene group, a p-phenylene group, a bivalent group having two p-phenylene groups bonded with a methylene group, or a bivalent group having two p-phenylene groups bonded with an oxygen atom.

$Y^{61}$ in the formula (F) represents a single bond, a methylene group, an ethylidene group, a propylidene group, a cyclohexylidene group, a phenylethylidene group, or a phenylmethylene group, and $R^{61}$ to $R^{68}$ each independently represent a hydrogen atom or a methyl group. Table 4 below shows examples of the structural unit represented by the formula (F).

TABLE 4

| Formula (F) | $m^{61}$ | $X^{61}$ | $R^{61}$, $R^{62}$ | $R^{63}$, $R^{64}$ | $R^{65}$, $R^{66}$ | $R^{67}$, $R^{68}$ | $Y^{61}$ |
|---|---|---|---|---|---|---|---|
| F-1 | 1 | o-Phenylene | Methyl | H | H | H | Propylidene |
| F-2 | 1 | m-Phenylene | Methyl | H | H | H | Propylidene |
| F-3 | 1 | p-Phenylene | Methyl | H | H | H | Propylidene |
| F-4 | 1 | m-Phenylene | Methyl | Methyl | H | H | Single bond |
| F-5 | 1 | p-Phenylene | Methyl | Methyl | H | H | Single bond |
| F-6 | 1 | 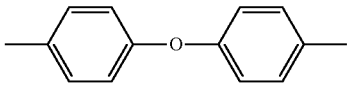 | Methyl | H | H | H | Propylidene |

TABLE 4-continued

| Formula (F) | $m^{61}$ | $X^{61}$ | $R^{61}$, $R^{62}$ | $R^{63}$, $R^{64}$ | $R^{65}$, $R^{66}$ | $R^{67}$, $R^{68}$ | $Y^{61}$ |
|---|---|---|---|---|---|---|---|
| F-7 | 1 | 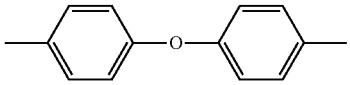 | Methyl | H | H | H | ethylidene |
| F-8 | 1 | m-Phenylene | Methyl | Methyl | H | H | Methylene |
| F-9 | 1 | p-Phenylene | Methyl | Methyl | H | H | Methylene |
| F-10 | 1 | p-Phenylene | H | H | H | H | Methylene |
| F-11 | 1 | 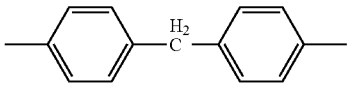 | Methyl | H | H | H | Propylidene |
| F-12 | 1 | p-Phenylene | H | H | H | H | Phenylethylidene |
| F-13 | 1 | 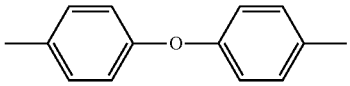 | H | H | H | H | Single bond |
| F-14 | 1 | 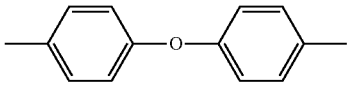 | H | H | H | H | Propylidene |
| F-15 | 1 | m-Phenylene | Methyl | Methyl | H | H | Single bond |
| F-16 | 1 | p-Phenylene | Methyl | H | H | H | Phenylethylidene |
| F-17 | 1 | p-Phenylene | H | H | H | H | Propylidene |
| F-18 | 1 | p-Phenylene | H | H | H | H | Cyclohexylidene |
| F-19 | 0 | — | Methyl | H | H | H | Propylidene |
| F-20 | 0 | — | Methyl | H | H | H | Ethylidene |
| F-21 | 0 | — | Methyl | Methyl | H | H | Methylene |
| F-22 | 0 | — | H | H | H | H | Phenylmethylene |
| F-23 | 0 | — | H | H | H | H | Single bond |
| F-24 | 0 | — | Methyl | H | H | H | Single bond |
| F-25 | 0 | — | Methyl | Methyl | H | H | Single bond |
| F-26 | 0 | — | H | H | H | H | Phenylethylidene |
| F-27 | 0 | — | H | H | H | H | Propylidene |
| F-28 | 0 | — | H | H | H | H | Cyclohexylidene |

Of those, a structural unit represented by the formula (F-19), (F-23), (F-24), (F-25), (F-26), (F-27), or (F-28) is preferred.

Next, the polycarbonate resin D having the structural unit represented by the formula (D) and the structural unit represented by the formula (E) is described.

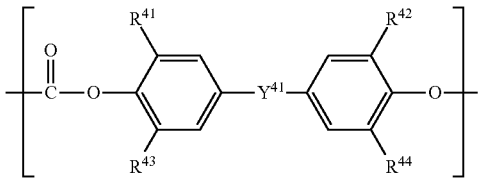

(D)

$Y^{41}$ in the formula (D) represents an oxygen atom or a sulfur atom. $R^{41}$ to $R^{44}$ each independently represent a hydrogen atom or a methyl group.

Examples of the structural unit represented by the formula (D) are shown below.

(D-1)

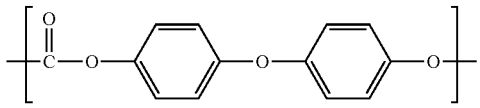

(D-2)

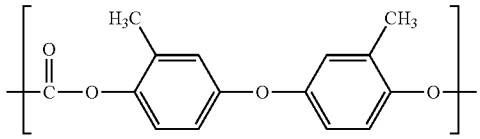

(D-3)

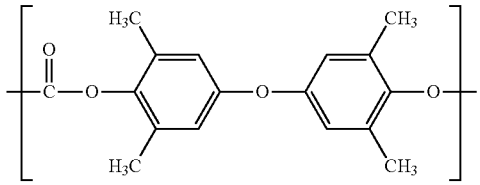

(D-4)

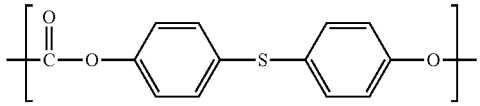

Of those, a structural unit represented by the formula (D-1), (D-2), or (D-3) is preferred.

(E)

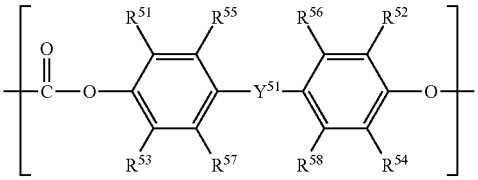

$Y^{51}$ in the formula (E) represents a single bond, a methylene group, an ethylidene group, a propylidene group, a cyclohexylidene group, a phenylethylidene group, or a phenylmethylene group.

$R^{51}$ to $R^{58}$ in the formula (E) each independently represent a hydrogen atom or a methyl group. Examples of the structural unit represented by the formula (E) are shown below.

(E-1)

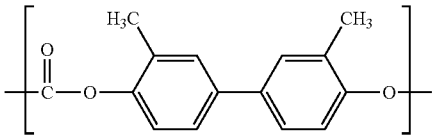

(E-2)

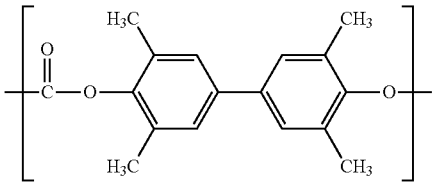

(E-3)

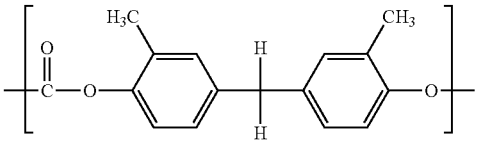

(E-4)

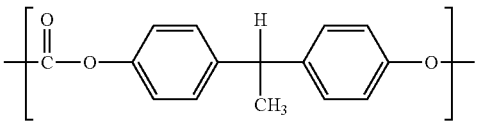

(E-5)

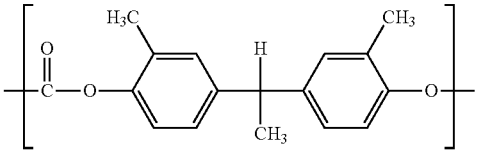

(E-6)

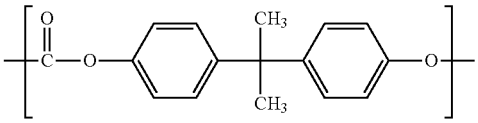

-continued (E-7)

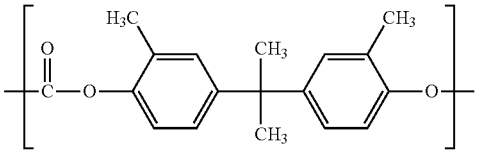

(E-8)

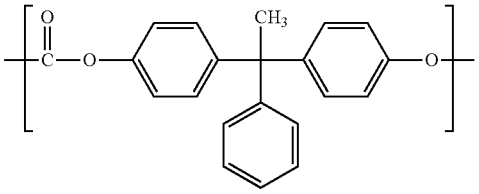

(E-9)

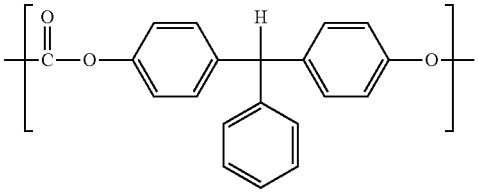

(E-10)

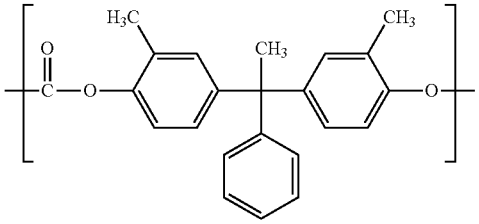

(E-11)

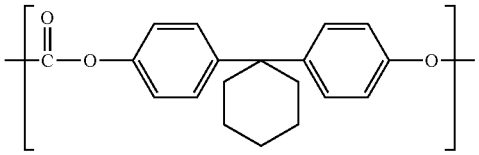

(E-12)

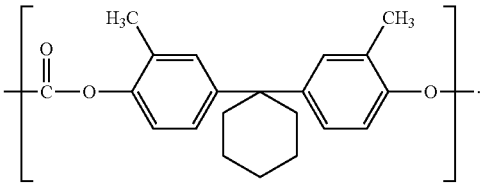

Of those, a structural unit represented by the formula (E-4), (E-5), (E-6), (E-7), (E-8), (E-10), (E-11), or (E-12) is preferred.

The charge-transporting layer has the matrix-domain structure that has the matrix containing the charge-transporting substance and the polycarbonate resin D, and has, in the matrix, the domain containing the resin A. The matrix-domain structure in the present invention can be confirmed by observing the surface of the charge-transporting layer or observing a section of the charge-transporting layer.

The observation of the state of the matrix-domain structure or the measurement of the domain can be performed with, for example, a commercially available laser microscope, optical microscope, electron microscope, or atomic force microscope. The observation of the state of the matrix-domain structure or the measurement of the domain structures can be performed with the microscope at a predetermined magnification.

Further, the resin A may have a siloxane structure represented by the following formula (A-E) at an end thereof.

(A-E)

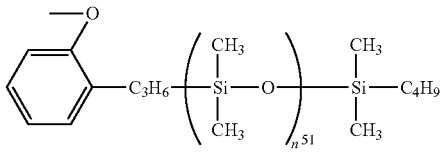

$n^{51}$ in the formula (A-E) represents the number of repetitions of a structure within parentheses and the average of $n^{51}$ in the formula (A-E) ranges from 10 to 60.

The particle size distribution of the particle diameters of the respective domain is preferably narrow from the viewpoints of a coating film and the uniformity of a stress-relaxing effect. The number average particle diameter of the domain is calculated as described below. 100 Domains are arbitrarily selected from domains observed through the observation of a section obtained by vertically cutting the charge-transporting layer with a microscope. The maximum diameters of the respective selected domains are measured and the maximum diameters of the respective domains are averaged. Thus, the number average particle diameter is calculated. It should be noted that when the section of the charge-transporting layer is observed with the microscope, image information on its depth direction is obtained and hence a three-dimensional image of the charge-transporting layer can also be obtained. The number average particle diameter of the domain is preferably from 10 nm to 1,000 nm.

The matrix-domain structure of the charge-transporting layer can be formed by using a coating film of an application liquid for a charge-transporting layer containing the charge-transporting substance, the resin A, and the polycarbonate resin D.

When the matrix-domain structure is uniformly formed in the charge-transporting layer, the sustainable relaxation of the contact stress is exhibited in an additionally effective manner. In addition, the incorporation of the polycarbonate resin D may facilitate the formation of the domains. This is probably because the polycarbonate resin D has the structural unit represented by the formula (D), and hence compatibility between the resin A and the resin D is improved, liquid stability is maintained in the application liquid for a charge-transporting layer, and the formation of the matrix-domain structure is facilitated at the time of the formation of the coating film.

It is assumed that when the compatibility is improved, the localization of the resin A having the siloxane structure toward an interface between the charge-transporting layer and a charge-generating layer is suppressed, and hence a potential variation at the time of the repeated use of the electrophotographic photosensitive member can be suppressed. In addition, it is assumed that when the matrix-domain structure is formed, the resin A is uniformly present in the coating film and hence the sustainable relaxing effect on the contact stress is exhibited.

In addition, in the present invention, the content of the structural unit represented by the formula (A-1) or the formula (A-2) in the resin A is from 5% by mass to 25% by mass based on the total mass of the resin A, and the content of the structural unit represented by the formula (B) is from 25% by mass to 95% by mass based on the total mass of the resin A.

In addition, the content of the structural unit represented by the formula (D) is from 10% by mass to 60% by mass based on the total mass of the polycarbonate resin D, and the content of the structural unit represented by the formula (E) is from 40% by mass to 90% by mass based on the total mass of the polycarbonate resin D.

When the contents of those structural units fall within the ranges, the domains are uniformly formed in the matrix containing the charge-transporting substance and the polycarbonate resin D. Thus, the sustainable relaxation of the contact stress is effectively exhibited. In addition, the localization of the resin A toward the interface between the charge-generating layer and the charge-transporting layer is suppressed, and hence the potential variation is suppressed.

Further, from the viewpoint of uniformly forming the domain in the matrix, the content of the resin A is preferably from 5% by mass to 50% by mass based on whole resins in the charge-transporting layer. The content is more preferably from 10% by mass to 40% by mass.

When the resin A contains the structural unit represented by the formula (C), the contents of the respective structural units are preferably as described below. That is, the content of the structural unit represented by the formula (A-1) or the formula (A-2) is from 5% by mass to 25% by mass based on the total mass of the resin A. The content of the structural unit represented by the formula (B) is from 35% by mass to 65% by mass based on the total mass of the resin A. In addition, the content of the structural unit represented by the formula (C) is from 10% by mass to 60% by mass based on the total mass of the resin A.

In addition, the resin A can contain the structural unit represented by the formula (F).

When the resin A contains the structural unit represented by the formula (C) and the structural unit represented by the formula (F), the contents of the respective structural units are preferably as described below. That is, the content of the structural unit represented by the formula (A-1) or the formula (A-2) is from 5% by mass to 25% by mass based on the total mass of the resin A. The content of the structural unit represented by the formula (B) is from 35% by mass to 65% by mass based on the total mass of the resin A. The content of the structural unit represented by the formula (C) is from 10% by mass to 60% by mass based on the total mass of the resin A. In addition, the content of the structural unit represented by the formula (F) is 30% by mass or less. It is more preferred that the content of the structural unit represented by the formula (F) be from 1% by mass to 30% by mass.

The resin A is a copolymer including the structural unit represented by the formulae (A-1) or (A-2) and the structural unit represented by the formula (B). Its form of copolymerization may be any form such as block copolymerization, random copolymerization, or alternating copolymerization.

From the viewpoint of forming the domain structures in the matrix containing the charge-transporting substance and the polycarbonate resin D, the weight average molecular weight of the resin A is preferably from 30,000 to 200,000, more preferably from 40,000 to 150,000.

The polycarbonate resin D to be used in the present invention is a copolymer including the structural unit represented by the formula (D) and the structural unit represented by the formula (E). Its form of copolymerization may be any form such as block copolymerization, random copolymerization, or alternating copolymerization.

From the viewpoint of forming the domain structure containing the resin A in the matrix containing the charge-transporting substance and the polycarbonate resin D, the weight average molecular weight of the polycarbonate resin D to be used in the present invention is preferably from 30,000 to 250,000, more preferably from 40,000 to 200,000.

In the present invention, the weight average molecular weight of the resin is a weight-average molecular weight in terms of polystyrene measured according to a conventional method, specifically a method described in Japanese Patent Application Laid-Open No. 2007-79555.

A copolymerization ratio between the resin A and polycarbonate resin D to be used in the present invention can be confirmed by a conversion method based on a peak area ratio between the hydrogen atoms of the resins (constituent hydrogen atoms of the resins) obtained by $^{1}$H-NMR measurement as a general approach.

The resin A and polycarbonate resin D to be used in the present invention can each be synthesized by a conventional phosgene method, for example. In addition, each of the resins can also be synthesized by a transesterification method.

Synthesis examples of the resin A to be used in the present invention are described below.

The resin A can be synthesized by employing a synthesis method described in Japanese Patent Application Laid-Open No. 2007-199688. In the present invention as well, the resin A shown in the column "Synthesis Example" of Table 5 was synthesized by employing the same synthesis method from raw materials corresponding to the structural unit represented by the formula (A-1) or (A-2) and the structural unit represented by the formula (B). Table 5 shows the construction and weight average molecular weight of the synthesized resin A. In addition, the resin H shown in the column "Comparative Synthesis Example" of Table 6 was synthesized by employing the same synthesis method. Table 6 shows the construction and weight average molecular weight of the synthesized resin H.

TABLE 5

| Synthesis Example | Resin A | Formula (A-1) or (A-2) | Formula (B) | Formula (C) | Formula (F) | Average of $n^{51}$ in formula (A-E) | Content (% by mass) of formula (A-1) or (A-2) | Content (% by mass) of formula (B) | Content (% by mass) of formula (C) | Content (% by mass) of formula (F) | Content (% by mass) of formula (A-E) | Mw |
|---|---|---|---|---|---|---|---|---|---|---|---|---|
| 1 | A(1) | A-1-2/ A-1-6 = 3/7 | B-3/ B-4 = 3/7 | — | — | — | 10 | 90 | — | — | — | 90,000 |
| 2 | A(2) | A-1-4/ A-1-7 = 3/7 | B-3/ B-4 = 3/7 | — | — | — | 10 | 90 | — | — | — | 88,000 |
| 3 | A(3) | A-1-2/ A-1-6 = 4/6 | B-3/ B-4 = 3/7 | — | — | — | 10 | 90 | — | — | — | 95,000 |
| 4 | A(4) | A-1-4/ A-1-7 = 4/6 | B-3/ B-4 = 3/7 | — | — | — | 10 | 90 | — | — | — | 93,000 |
| 5 | A(5) | A-1-2/ A-1-6 = 2/8 | B-3/ B-4 = 3/7 | — | — | — | 10 | 90 | — | — | — | 94,000 |
| 6 | A(6) | A-1-4/ A-1-7 = 2/8 | B-3/ B-4 = 3/7 | — | — | — | 10 | 90 | — | — | — | 89,000 |
| 7 | A(7) | A-1-2 | B-3 | — | — | — | 20 | 80 | — | — | — | 90,000 |
| 8 | A(8) | A-1-4 | B-3 | — | — | — | 20 | 80 | — | — | — | 100,000 |
| 9 | A(9) | A-1-6 | B-4 | — | — | — | 20 | 80 | — | — | — | 110,000 |
| 10 | A(10) | A-1-7 | B-4 | — | — | — | 20 | 80 | — | — | — | 78,000 |
| 11 | A(11) | A-1-10 | B-2 | — | — | — | 25 | 75 | — | — | — | 60,000 |
| 12 | A(12) | A-1-8 | B-1 | — | — | — | 25 | 75 | — | — | — | 130,000 |
| 13 | A(13) | A-1-11 | B-5 | — | — | — | 10 | 90 | — | — | — | 40,000 |
| 14 | A(14) | A-2-2 | B-3 | — | — | — | 10 | 90 | — | — | — | 150,000 |
| 15 | A(15) | A-2-6 | B-4 | — | — | — | 10 | 90 | — | — | — | 100,000 |
| 16 | A(16) | A-2-2/ A-2-6 = 3/7 | B-3/ B-4 = 3/7 | — | — | — | 5 | 95 | — | — | — | 60,000 |
| 17 | A(17) | A-1-2 | B-3 | — | — | 40 | 20 | 80 | — | — | 10 | 90,000 |
| 18 | A(18) | A-1-20 | B-6 | — | — | — | 20 | 80 | — | — | — | 80,000 |
| 19 | A(19) | A-2-20 | B-6 | — | — | — | 10 | 90 | — | — | — | 75,000 |
| 20 | A(20) | A-1-20 | B-6 | C-21 | — | — | 10 | 50 | 40 | — | — | 90,000 |
| 21 | A(21) | A-1-20 | B-6 | C-21 | — | — | 20 | 40 | 40 | — | — | 79,000 |
| 22 | A(22) | A-1-20 | B-6 | C-21 | — | — | 10 | 45 | 45 | — | — | 82,000 |
| 23 | A(23) | A-1-20 | B-6 | C-21 | — | — | 20 | 35 | 45 | — | — | 110,000 |
| 24 | A(24) | A-1-20 | B-6 | C-21 | — | — | 20 | 65 | 15 | — | — | 130,000 |
| 25 | A(25) | A-1-20 | B-6 | C-21 | — | — | 25 | 65 | 10 | — | — | 60,000 |
| 26 | A(26) | A-1-20 | B-6 | C-21 | — | — | 5 | 35 | 60 | — | — | 80,000 |
| 27 | A(27) | A-1-21 | B-6 | C-21 | — | — | 10 | 50 | 40 | — | — | 40,000 |
| 28 | A(28) | A-1-21 | B-6 | C-21 | — | — | 20 | 40 | 40 | — | — | 150,000 |
| 29 | A(29) | A-1-20 | B-6 | C-21 | — | 10 | 20 | 40 | 40 | — | 10 | 79,000 |
| 30 | A(30) | A-1-20 | B-6 | C-21 | — | 40 | 20 | 40 | 40 | — | 5 | 88,000 |
| 31 | A(31) | A-1-20 | B-6 | C-21 | — | 60 | 20 | 40 | 40 | — | 15 | 65,000 |
| 32 | A(32) | A-1-22 | B-6 | C-22 | — | — | 10 | 50 | 40 | — | — | 90,000 |
| 33 | A(33) | A-1-23 | B-6 | C-23 | — | — | 10 | 50 | 40 | — | — | 79,000 |
| 34 | A(34) | A-1-24 | B-6 | C-24 | — | — | 10 | 50 | 40 | — | — | 82,000 |
| 35 | A(35) | A-1-25 | B-6 | C-25 | — | — | 10 | 50 | 40 | — | — | 110,000 |
| 36 | A(36) | A-2-23 | B-6 | C-22 | — | — | 20 | 50 | 30 | — | — | 110,000 |
| 37 | A(37) | A-2-24 | B-6 | C-22 | — | — | 20 | 40 | 40 | — | — | 130,000 |
| 38 | A(38) | A-2-25 | B-6 | C-22 | — | — | 20 | 40 | 40 | — | — | 60,000 |

TABLE 5-continued

| Synthesis Example | Resin A | Formula (A-1) or (A-2) | Formula (B) | Formula (C) | Formula (F) | Average of $n^{51}$ in formula (A-E) | Content (% by mass) of formula (A-1) or (A-2) | Content (% by mass) of formula (B) | Content (% by mass) of formula (C) | Content (% by mass) of formula (F) | Content (% by mass) of formula (A-E) | Mw |
|---|---|---|---|---|---|---|---|---|---|---|---|---|
| 39 | A(39) | A-1-20 | B-6 | C-21 | F-19 | — | 10 | 50 | 20 | 20 | — | 79,000 |
| 40 | A(40) | A-1-20 | B-6 | C-21 | F-23 | — | 10 | 50 | 30 | 10 | — | 88,000 |
| 41 | A(41) | A-1-20 | B-6 | C-21 | F-24 | — | 10 | 50 | 35 | 5 | — | 65,000 |
| 42 | A(42) | A-1-20 | B-6 | C-21 | F-25 | — | 10 | 30 | 30 | 30 | — | 90,000 |
| 43 | A(43) | A-1-20 | B-6 | C-21 | F-26 | — | 10 | 50 | 20 | 20 | — | 79,000 |
| 44 | A(44) | A-1-20 | B-6 | C-21 | F-27 | — | 10 | 50 | 30 | 10 | — | 82,000 |
| 45 | A(45) | A-1-20 | B-6 | C-21 | F-28 | — | 10 | 50 | 30 | 10 | — | 110,000 |
| 46 | A(46) | A-1-20 | B-6 | C-21 | F-28 | 40 | 20 | 40 | 30 | 10 | 10 | 82,000 |

TABLE 6

| Comparative Synthesis Example | Resin H | Formula (A-1) or (A-2) | Formula (B) | Formula (C) | Formula (F) | Average of $n^{51}$ in formula (A-E) | Content (% by mass) of formula (A-1) or (A-2) | Content (% by mass) of formula (B) | Content (% by mass) of formula (C) | Content (% by mass) of formula (F) | Content (% by mass) of formula (A-E) | Mw |
|---|---|---|---|---|---|---|---|---|---|---|---|---|
| 1 | H (1) | A-1-20 | B-6 | C-21 | — | — | 30 | 50 | 20 | — | — | 80,000 |
| 2 | H (2) | A-1-20 | B-6 | C-21 | — | — | 3 | 50 | 47 | — | — | 90,000 |
| 3 | H (3) | A-1-20 | B-6 | C-21 | — | — | 20 | 20 | 60 | — | — | 76,000 |
| 4 | H (4) | A-1-20 | B-6 | C-21 | — | — | 5 | 25 | 70 | — | — | 93,000 |
| 5 | H (5) | A-1-20 | B-6 | C-21 | — | — | 30 | 65 | 5 | — | — | 130,000 |
| 6 | H (6) | A-1-20 | — | C-21 | F-28 | 40 | 20 | — | 20 | 60 | 10 | 60,000 |
| 7 | H (7) | A-1-20 | — | C-21 | F-28 | — | 20 | — | 40 | 40 | — | 78,000 |
| 8 | H (8) | A-1-20 | — | — | F-26 | — | 20 | — | — | 80 | — | 55,000 |

The column "Formula (A-1) or (A-2)" in Table 5 or 6 means the structural unit represented by the formula (A-1) or (A-2). When structural units represented by the formula (A-1) or (A-2) are used as a mixture, the column shows the kinds of, and a molar mixing ratio between, the structural units. The column "Formula (B)" means the structural unit represented by the formula (B). When structural units represented by the formula (B) are used as a mixture, the column shows the kinds of, and a molar mixing ratio between, the structural units. The column "Formula (C)" means the structural unit represented by the formula (C) to be incorporated into the resin A or the resin H. The column "Formula (F)" in Table 5 or 6 means the structural unit represented by the formula (F) to be incorporated into the resin A or the resin H. The column "Average of $n^{51}$ in formula (A-E)" means the average number of repetitions of the structural unit represented by the formula (A-E) to be incorporated into the resin A or the resin H. The column "Content (% by mass) of formula (A-1) or (A-2)" means the content (% by mass) of the structural unit represented by the formula (A-1) or (A-2) in the resin A or the resin H. The column "Content (% by mass) of formula (B)" means the content (% by mass) of the structural unit represented by the formula (B) in the resin A or the resin H. The column "Content (% by mass) of formula (C)" means the content (% by mass) of the structural unit represented by the formula (C) in the resin A or the resin H. The column "Content (% by mass) of formula (F)" means the content (% by mass) of the structural unit represented by the formula (F) in the resin A or the resin H. The column "Content (% by mass) of formula (A-E)" means the content (% by mass) of the structural unit represented by the formula (A-E) in the resin A or the resin H. The column "Mw" means the weight average molecular weight of the resin A or the resin H.

Synthesis examples of the polycarbonate resins D and I are described below.

The polycarbonate resins D and I can be synthesized by, for example, a conventional phosgene method. The resin can also be synthesized by a transesterification method.

TABLE 7

| Synthesis Example | Polycarbonate Resin D | Formula (D) | Formula (E) | Content (% by mass) of formula (D) | Content (% by mass) of formula (E) | Mw |
|---|---|---|---|---|---|---|
| 1 | D (1) | D-1 | E-1 | 30 | 70 | 90,000 |
| 2 | D (2) | D-1 | E-2 | 30 | 70 | 88,000 |
| 3 | D (3) | D-1 | E-3 | 30 | 70 | 95,000 |
| 4 | D (4) | D-1 | E-4 | 30 | 70 | 93,000 |

TABLE 7-continued

| Synthesis Example | Polycarbonate Resin D | Formula (D) | Formula (E) | Content (% by mass) of formula (D) | Content (% by mass) of formula (E) | Mw |
|---|---|---|---|---|---|---|
| 5 | D (5) | D-1 | E-5 | 30 | 70 | 94,000 |
| 6 | D (6) | D-1 | E-6 | 30 | 70 | 89,000 |
| 7 | D (7) | D-1 | E-7 | 30 | 70 | 90,000 |
| 8 | D (8) | D-1 | E-8 | 30 | 70 | 100,000 |
| 9 | D (9) | D-1 | E-9 | 30 | 70 | 110,000 |
| 10 | D (10) | D-1 | E-10 | 30 | 70 | 78,000 |
| 11 | D (11) | D-1 | E-11 | 30 | 70 | 60,000 |
| 12 | D (12) | D-1 | E-12 | 30 | 70 | 130,000 |
| 13 | D (13) | D-1 | E-10 | 10 | 90 | 40,000 |
| 14 | D (14) | D-1 | E-10 | 60 | 40 | 150,000 |
| 15 | D (15) | D-2 | E-7 | 30 | 70 | 100,000 |
| 16 | D (16) | D-3 | E-7 | 30 | 70 | 40,000 |
| 17 | D (17) | D-4 | E-7 | 30 | 70 | 200,000 |
| 18 | D (18) | D-1 | E-7/E-8 = 5/2 | 30 | 70 | 80,000 |
| 19 | D (19) | D-1 | E-7/E-8 = 7/2 | 10 | 90 | 110,000 |
| 20 | D (20) | D-1 | E-7/E-8 = 3/1 | 60 | 40 | 100,000 |
| 21 | D (21) | D-1 | E-6/E-10 = 5/2 | 30 | 70 | 75,000 |
| 22 | D (22) | D-1 | E-5/E-12 = 4/4 | 20 | 80 | 90,000 |
| 23 | D (23) | D-1 | E-2/E-8 = 2/4 | 40 | 60 | 79,000 |
| 24 | D (24) | D-1 | E-5/E-10 = 2/3 | 50 | 50 | 82,000 |
| 25 | D (25) | D-1 | E-6/E-8 = 7/2 | 10 | 90 | 110,000 |
| 26 | D (26) | D-1 | E-6/E-8 = 4/3 | 30 | 70 | 130,000 |
| 27 | D (27) | D-1 | E-6/E-8 = 2/2 | 60 | 40 | 60,000 |
| 28 | D (28) | D-1 | E-4/E-8 = 6/3 | 10 | 90 | 80,000 |
| 29 | D (29) | D-1 | E-4/E-8 = 4/3 | 30 | 70 | 40,000 |
| 30 | D (30) | D-1 | E-4/E-8 = 1/3 | 60 | 40 | 150,000 |

TABLE 8

| Comparative Synthesis Example | Polycarbonate Resin I | Formula (D) | Formula (E) | Content (% by mass) of formula (D) | Content (% by mass) of formula (E) | Mw |
|---|---|---|---|---|---|---|
| 1 | I (1) | D-1 | E-1 | 5 | 95 | 80,000 |
| 2 | I (2) | D-1 | E-1 | 70 | 30 | 90,000 |
| 3 | I (3) | — | E-6 | — | 100 | 76,000 |

The column "Formula (D)" in Table 7 or 8 means the structural unit represented by the formula (D). The column "Formula (E)" means the structural unit represented by the formula (E). When structural units represented by the formula (E) are used as a mixture, the column shows the kinds of, and a mass mixing ratio between, the structural units. The column "Content (% by mass) of formula (D)" means the content (% by mass) of the structural unit represented by the formula (D) to be incorporated into the polycarbonate resin D or the polycarbonate resin I. The column "Content (% by mass) of formula (E)" means the content (% by mass) of the structural unit represented by the formula (E) in the polycarbonate resin D or the polycarbonate resin I. The column "Mw" means the weight average molecular weight of the polycarbonate resin D or the polycarbonate resin I.

Although the charge-transporting layer as the surface layer of the electrophotographic photosensitive member of the present invention contains the resin A and the polycarbonate resin D, any other resin may be further mixed and used together with the resins. Examples of the other resin that may be mixed and used together with the resins include an acrylic resin, a polyester resin, and a polycarbonate resin.

In addition, the polycarbonate resin D is preferably free of any structural unit represented by the formula (A-1) or the formula (A-2) from the viewpoint of the uniform formation of the matrix-domain structure.

The charge-transporting layer as the surface layer of the electrophotographic photosensitive member of the present invention contains the charge-transporting substance. Examples of the charge-transporting substance include a triarylamine compound, a hydrazone compound, a butadiene compound, and an enamine compound. One kind of those charge-transporting substances may be used alone, or two or more kinds thereof may be used. Of those, a triarylamine compound is preferably used as the charge-transporting substance from the viewpoint of improving electrophotographic characteristics.

Next, the construction of the electrophotographic photosensitive member of the present invention is described.

Figure 2A:
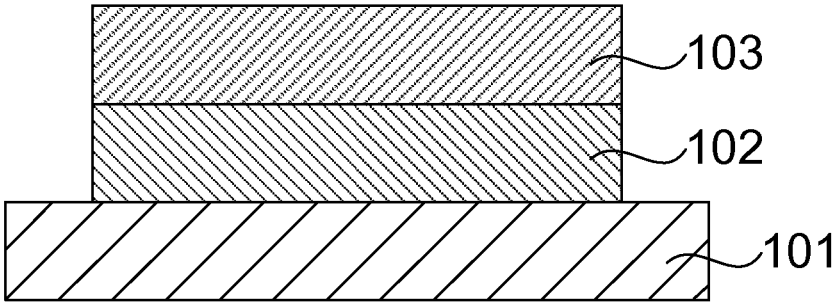
FIGS. 2A and 2B are each a view illustrating an example of the layer construction of the electrophotographic photosensitive member.
Figure 2B:
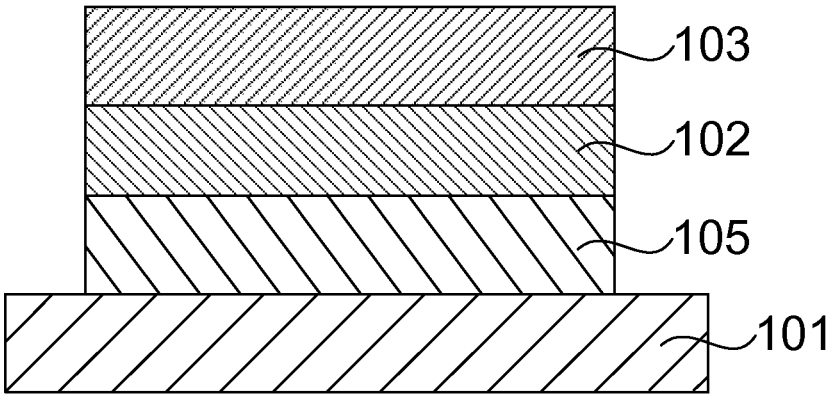

As described above, the electrophotographic photosensitive member of the present invention includes a support, a charge-generating layer on the support, and a charge-transporting layer on the charge-generating layer. In the electrophotographic photosensitive member, the charge-transporting layer is preferably a surface layer (outermost layer) of the electrophotographic photosensitive member. FIGS. 2A and 2B illustrate schematic views of the electrophotographic photosensitive member. In FIG. 2A, a charge-generating is formed on a support 101 and a charge-transporting layer 103 is formed on the charge-generating layer 102. In FIG. 2B, an undercoat layer 105 is formed on the support 101 and the charge-generating layer 102 is formed on the undercoat layer 105. The charge-transporting layer 103 is formed on the charge-generating layer.

Further, the charge-transporting layer of the electrophotographic photosensitive member of the present invention contains the charge-transporting substance. In addition, the charge-transporting layer contains the resin A and the polycarbonate resin D.

Further, the charge-transporting layer may have a laminated structure, and in such case, the layer is formed so that at least the charge-transporting layer on the outermost surface side has the above-mentioned matrix-domain structure.

In general, as the electrophotographic photosensitive member, a cylindrical electrophotographic photosensitive member produced by forming a photosensitive layer on a cylindrical support is widely used, but the member may be formed into a belt or sheet shape.

The support is preferably conductive (conductive support) and a support made of a metal such as aluminum, an aluminum alloy, or stainless steel may be used.

In the case of a support made of aluminum or an aluminum alloy, the support to be used may be an ED tube or an EI tube or one obtained by subjecting the tube to cutting, electro-chemical buffing (electrolysis with an electrode having an electrolytic action and an electrolytic solution, and buffing with a grindstone having a buffing action), or a wet- or dry-honing process.

Further, a support made of a metal or a support made of a resin having a layer obtained by forming aluminum, an aluminum alloy, or an indium oxide-tin oxide alloy into a film by means of vacuum deposition may be used. In addition, a support obtained by impregnating conductive particles such as carbon black, tin oxide particles, titanium oxide particles, or silver particles in a resin or the like, or a plastic having a conductive resin may be used. The surface of the support may be subjected to, for example, cutting treatment, roughening treatment, or alumite treatment.

A conductive layer may be formed between the support and the undercoat layer to be described later or the charge-generating layer for the purpose of suppressing interference fringes or covering a flaw of the support. The conductive layer is formed through the use of an application liquid for a conductive layer, which is prepared by dispersing conductive particles in a resin.

Examples of the conductive particles include carbon black, acetylene black, metal powders made of, for example, aluminum, nickel, iron, nichrome, copper, zinc, and silver, and metal oxide powders made of, for example, conductive tin oxide and ITO.

In addition, examples of the resin include a polyester resin, a polycarbonate resin, a polyvinyl butyral, an acrylic resin, a silicone resin, an epoxy resin, a melamine resin, a urethane resin, a phenol resin, and an alkyd resin.

As a solvent to be used for the application liquid for a conductive layer, there are given, for example, an ether-based solvent, an alcohol-based solvent, a ketone-based solvent, and an aromatic hydrocarbon solvent. The thickness of the conductive layer is preferably from 0.2 μm to 40 μm, more preferably from 1 μm to 35 μm, still more preferably from 5 μm to 30 μm.

The undercoat layer may be formed between the support or the conductive layer and the charge-generating layer. The undercoat layer can be formed by applying an application liquid for an undercoat layer containing a resin onto the support or the conductive layer and drying or curing the application liquid.

Examples of the resin in the undercoat layer include polyacrylic acids, methylcellulose, ethylcellulose, a polyamide resin, a polyimide resin, a polyamideimide resin, a polyamide acid resin, a melamine resin, an epoxy resin, a polyurethane resin, and a polyolefin resin.

The thickness of the undercoat layer is preferably from 0.05 μm to 7 μm, more preferably from 0.1 μm to 2 μm. The undercoat layer may further contain semiconductive particles, an electron-transporting substance, or an electron-accepting substance.

The charge-generating layer is formed on the support, conductive layer, or undercoat layer.

Examples of the charge-generating substance to be used in the electrophotographic photosensitive member of the present invention include azo pigments, phthalocyanine pigments, indigo pigments, and perylene pigments. Only one kind of those charge-generating substances may be used, or two or more kinds thereof may be used. Of those, metallophthalocyanines such as oxytitanium phthalocyanine, hydroxygallium phthalocyanine, and chlorogallium phthalocyanine are particularly preferred because of their high sensitivity.

Examples of the resin to be used in the charge-generating layer include a polycarbonate resin, a polyester resin, a butyral resin, a polyvinyl acetal resin, an acrylic resin, a vinyl acetate resin, and a urea resin. Of those, a butyral resin is particularly preferred. One kind of those resins may be used alone, or two or more kinds thereof may be used as a mixture or as a copolymer.

The charge-generating layer can be formed by applying an application liquid for a charge-generating layer, which is prepared by dispersing a charge-generating substance together with a resin and a solvent, and then drying the application liquid. Further, the charge-generating layer may also be a deposited film of a charge-generating substance.

Examples of the dispersion method include methods each using a homogenizer, an ultrasonic wave, a ball mill, a sand mill, an attritor, or a roll mill.

A ratio between the charge-generating substance and the resin falls within the range of preferably from 1:10 to 10:1 (mass ratio), particularly preferably from 1:1 to 3:1 (mass ratio).

The solvent to be used for the application liquid for a charge-generating layer is selected depending on the solubility and dispersion stability of each of the resin and charge-generating substance to be used. Examples of the solvent include organic solvents such as an alcohol-based solvent, a sulfoxide-based solvent, a ketone-based solvent, an ether-based solvent, an ester-based solvent, and an aromatic hydrocarbon solvent. The thickness of the charge-generating layer is preferably 5 μm or less, more preferably from 0.1 μm to 2 μm.

Further, any of various sensitizers, antioxidants, UV absorbers, plasticizers, and the like may be added to the charge-generating layer, if required. An electron-transporting substance or an electron-accepting substance may also be incorporated into the charge-generating layer to prevent the flow of charge from being disrupted in the charge-generating layer.

The charge-transporting layer is formed on the charge-generating layer.

The charge-transporting layer as the surface layer of the electrophotographic photosensitive member of the present invention contains the charge-transporting substance. Examples of the charge-transporting substance to be incorporated include a triarylamine compound, a hydrazone compound, a butadiene compound, and an enamine compound. Of those, a triarylamine compound is preferably used as the charge-transporting substance in terms of improvements in electrophotographic characteristics.

Examples of the charge-transporting substance are shown below.

The charge-transporting layer as the surface layer of the electrophotographic photosensitive member contains the resin A and also contains the polycarbonate resin D, but as described above, any other resin may be further be mixed and used together with the resins. The other resin that may be mixed and used together with the resins is as described above.

The charge-transporting layer can be formed by applying an application liquid for a charge-transporting layer, which is obtained by dissolving a charge-transporting substance and the above-mentioned resins into a solvent, onto the charge-generating layer and then drying the application liquid.

A ratio between the charge-transporting substance and the resins falls within the range of preferably from 4:10 to 20:10 (mass ratio), more preferably from 5:10 to 12:10 (mass ratio).

Examples of the solvent to be used for the application liquid for a charge-transporting layer include ketone-based solvents, ester-based solvents, ether-based solvents, and aromatic hydrocarbon solvents. Those solvents may be used each alone or as a mixture of two or more kinds thereof. Of (G-1)

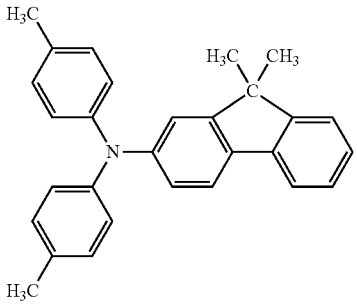

(G-2)

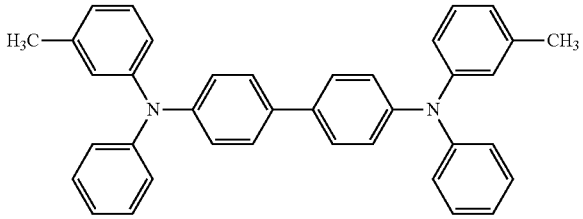

(G-3)

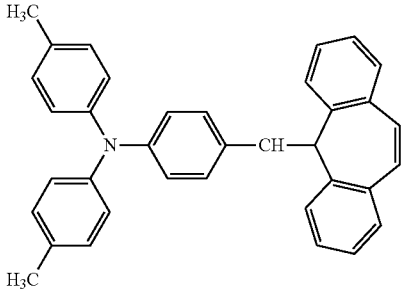

(G-4)

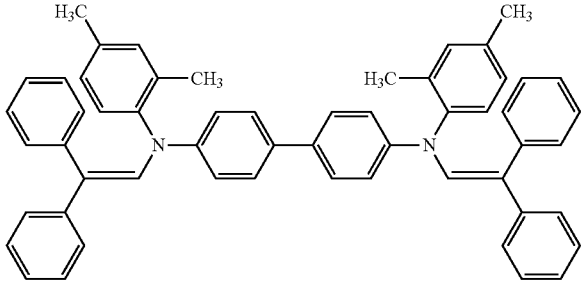

(G-5)

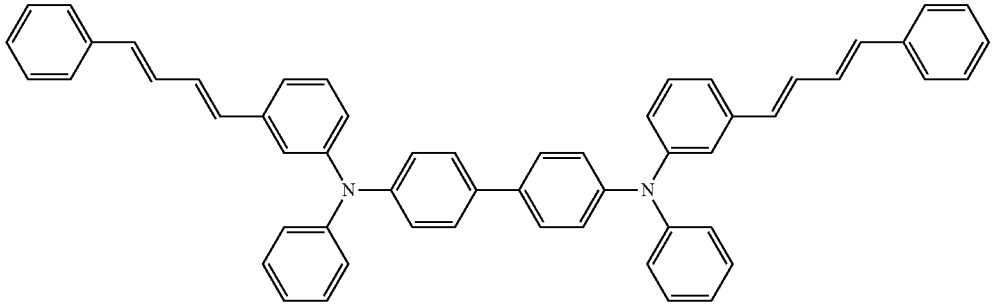

those solvents, it is preferred to use any of the ether-based solvents and the aromatic hydrocarbon solvents from the viewpoint of resin solubility.

The charge-transporting layer has a thickness of preferably from 5 μm to 50 μm, more preferably from 10 μm to 35 μm.

In addition, an antioxidant, a UV absorber, a plasticizer, or the like may be added to the charge-transporting layer, if required.

A variety of additives may be added to each layer of the electrophotographic photosensitive member of the present invention. Examples of the additives include: an antidegradant such as an antioxidant, a UV absorber, or a light resistant stabilizer; and fine particles such as organic fine particles or inorganic fine particles. Examples of the antidegradant include a hindered phenol-based antioxidant, a hindered amine-based light resistant stabilizer, a sulfur atom-containing antioxidant, and a phosphorus atom-containing antioxidant. Examples of the organic fine particles include polymer resin particles such as fluorine atom-containing resin particles, polystyrene fine particles, and polyethylene resin particles. Examples of the inorganic fine particles include metal oxides such as silica and alumina.

For the application of each of the application liquids corresponding to the above-mentioned respective layers, any of the application methods may be employed, such as a dip applying method (dip coating method), a spraying coating method, a spinner coating method, a roller coating method, a Meyer bar coating method, and a blade coating method.

In addition, an uneven shape (a concave and a convex) may be formed in the surface of the charge-transporting layer as the surface layer of the electrophotographic photosensitive member of the present invention. A known method can be adopted as a method of forming the uneven shape. Examples of the forming method include: a method involving spraying the surface of the charge-transporting layer with abrasive particles to form concaves; a method involving bringing a mold having the uneven shape into press contact with the surface to form the uneven shape; a method involving causing condensation on the surface of the coating film of the applied application liquid for a charge-transporting layer, and then drying the coating film to form concaves; and a method involving irradiating the surface with laser light to form concaves. Of those, a method involving bringing a mold having the uneven shape into press contact with the surface of the surface layer of the electrophotographic photosensitive member to form the uneven shape is preferred. A method involving causing condensation on the surface of the coating film of the applied application liquid for a charge-transporting layer, and then drying the coating film to form concaves is also preferred.

FIG. 1 illustrates an example of the schematic construction of an electrophotographic apparatus including a process cartridge including the electrophotographic photosensitive member of the present invention.

In FIG. 1, a cylindrical electrophotographic photosensitive member 1 is rotationally driven about an axis 2 in a direction indicated by an arrow at a predetermined peripheral speed. The surface of the electrophotographic photosensitive member 1 to be rotationally driven is uniformly charged to a positive or negative predetermined potential by a charging unit 3 (primary charging unit: a charging roller or the like). Next, the surface receives exposure light 4 (image exposure light) output from an exposing unit (not shown) such as slit exposure or laser beam scanning exposure. Thus, electrostatic latent images corresponding to a target image are sequentially formed on the surface of the electrophotographic photosensitive member 1.

The electrostatic latent images formed on the surface of the electrophotographic photosensitive member 1 are developed with toners in the developers of a developing unit 5 to provide toner images. Next, the toner images formed and borne on the surface of the electrophotographic photosensitive member 1 are sequentially transferred onto a transfer material P (such as paper) by a transfer bias from a transfer unit 6 (such as a transfer roller). It should be noted that the transfer material P is taken out of a transfer material-supplying unit (not shown) and fed into a gap between the electrophotographic photosensitive member 1 and the transfer unit 6 (abutting portion) in synchronization with the rotation of the electrophotographic photosensitive member 1.

The transfer material P onto which the toner images have been transferred is separated from the surface of the electrophotographic photosensitive member 1 and then introduced to a fixing unit 8. The transfer material P is subjected to image fixation to be printed out as an image-formed product (print or copy) to the outside of the apparatus.

The surface of the electrophotographic photosensitive member 1 after the transfer of the toner images is cleaned by removal of the remaining developer (toner) after the transfer by a cleaning unit 7 (such as cleaning blade). Subsequently, the surface of the electrophotographic photosensitive member 1 is subjected to neutralization treatment with pre-exposure light (not shown) from a pre-exposing unit (not shown) and then repeatedly used in image formation. It should be noted that, as illustrated in FIG. 1, when the charging unit 3 is a contact-charging unit using a charging roller or the like, the pre-exposure is not always required.

Of the constituents including the electrophotographic photosensitive member 1, the charging unit 3, the developing unit 5, the transfer unit 6, and the cleaning unit 7, a plurality of them may be housed in a container and integrally combined to construct a process cartridge. In addition, the process cartridge may be designed so as to be removably mounted onto an electrophotographic apparatus body such as a copying machine or a laser beam printer. In FIG. 1, the electrophotographic photosensitive member 1, the charging unit 3, the developing unit 5, and the cleaning unit 7 are integrally supported and placed in a cartridge, thereby forming a process cartridge 9. The process cartridge 9 is removably mounted onto the electrophotographic apparatus body using a guiding unit 10 such as a rail of the electrophotographic apparatus body.

EXAMPLES

Hereinafter, the present invention is described in more detail with reference to specific examples. However, the present invention is not limited thereto. It should be noted that "part(s)" means "part(s) by mass" in the examples.

Example 1

An aluminum cylinder having a diameter of 24 mm and a length of 257 mm was used as a support.

Next, 10 parts of $SnO_2$-coated barium sulfate (conductive particle), 2 parts of titanium oxide (pigment for controlling resistance), 6 parts of a phenol resin, and 0.001 part of silicone oil (leveling agent) were used together with a mixed solvent of 4 parts of methanol and 16 parts of methoxypropanol, to thereby prepare an application liquid for a conductive layer.

The application liquid for a conductive layer was applied onto the support by dip coating and cured (thermally cured) at 140° C. for 30 minutes, to thereby form a conductive layer having a thickness of 15 μm.

Next, 3 parts of N-methoxymethylated nylon and 3 parts of copolymer nylon were dissolved in a mixed solvent of 65 parts of methanol and 30 parts of n-butanol, to thereby prepare an application liquid for an undercoat layer.

The application liquid for an undercoat layer was applied onto the conductive layer by dip coating and dried at 100° C. for 10 minutes, to thereby form an undercoat layer having a thickness of 0.7 μm.

Next, hydroxygallium phthalocyanine (charge-generating substance) having a crystal structure showing peaks at Bragg angles 2θ±0.2° of 7.5°, 9.9°, 16.3°, 18.6°, 25.1°, and 28.3° in CuKα characteristic X-ray diffraction was prepared. 10 Parts of the hydroxygallium phthalocyanine were added to a solution of 5 parts of a polyvinyl butyral resin (product name: S-LEC BX-1, manufactured by Sekisui Chemical Co., Ltd.) in 250 parts of cyclohexanone. The resultant mixture was dispersed by a sand mill apparatus using glass beads each having a diameter of 1 mm under a 23±3° C. atmosphere for 1 hour. After the dispersion, 250 parts of ethyl acetate were added to prepare an application liquid for a charge-generating layer.

The application liquid for a charge-generating layer was applied onto the undercoat layer by dip coating and dried at 100° C. for 10 minutes, to thereby form a charge-generating layer having a thickness of 0.26 μm.

Next, 9 parts of a charge-transporting substance represented by the formula (G-1), 1 part of a charge-transporting substance represented by the formula (G-3), 3 parts of the resin A (1) synthesized in Synthesis Example 1, and 7 parts of the polycarbonate resin D (1) were dissolved in a mixed solvent containing 30 parts of dimethoxymethane and 50 parts of orthoxylene to prepare an application liquid for a charge-transporting layer.

The application liquid for a charge-transporting layer was applied onto the charge-generating layer by dip coating, and the applied liquid was dried for 1 hour at 120° C. to form a charge-transporting layer having a thickness of 16 μm. It was confirmed that the formed charge-transporting layer contained, in a matrix containing the charge-transporting substances and the polycarbonate resin D, a domain containing the resin A (1).

Thus, an electrophotographic photosensitive member whose surface layer was the charge-transporting layer was produced. Table 9 shows the constructions of the resins in the charge-transporting layer.

Next, evaluation is described.

Evaluation was performed for a variation (potential variation) of bright section potentials in 7,000-sheet repeated use, torque relative values at an initial stage and after 7,000-sheet repeated use, and observation of the surface of the electrophotographic photosensitive member in measurement of the torques.

(Evaluation of Potential Variation)

A laser beam printer ColorLaser JET CP4525dn manufactured by Hewlett-Packard was used as an evaluation apparatus. Evaluation was performed under an environment of a temperature of 23° C. and a relative humidity of 50%. The exposure amount (image exposure amount) of a 780-nm laser light source of the evaluation apparatus was set so that the light intensity on the surface of the electrophotographic photosensitive member was 0.42 μJ/cm$^2$. Measurement of the potentials (dark section potential and bright section potential) of the surface of the electrophotographic photosensitive member was performed at a position of a developing device after replacing the developing device by a fixture fixed so that a probe for potential measurement was located at a position of 130 mm from the end of the electrophotographic photosensitive member. The dark section potential at an unexposed part of the electrophotographic photosensitive member was set to −500 V, laser light was irradiated, and the bright section potential obtained by light attenuation from the dark section potential was measured. Further, A4-size plain paper was used to continuously output an image on 7,000 sheets, and variations of the bright section potentials before and after the output were evaluated. A test chart having a printing ratio of 5% was used. The results are shown in the column "Potential variation" in Table 12.

(Evaluation of Torque Relative Value)

A driving current (current A) of a rotary motor of the electrophotographic photosensitive member was measured under the same conditions as those in the evaluation of the potential variation described above. This evaluation was performed for evaluating an amount of contact stress between the electrophotographic photosensitive member and the cleaning blade. The resultant current shows how large the amount of contact stress between the electrophotographic photosensitive member and the cleaning blade is.

Moreover, an electrophotographic photosensitive member for comparison of a torque relative value was produced by the following method. That is, an electrophotographic photosensitive member was produced in the same manner as in Example 1 except that the resin A (1) used in the resins in the charge-transporting layer of the electrophotographic photosensitive member in Example 1 was not used and the polycarbonate resin D (1) was used. The resultant electrophotographic photosensitive member was used as the electrophotographic photosensitive member for comparison. The resultant electrophotographic photosensitive member for comparison was used to measure a driving current (current B) of a rotary motor of the electrophotographic photosensitive member in the same manner as in Example 1.

A ratio of the driving current (current A) of the rotary motor of the electrophotographic photosensitive member using the resin A thus obtained to the driving current (current B) of the rotary motor of the electrophotographic photosensitive member not using the resin A was calculated. The resultant value of (current A)/(current B) was compared as a torque relative value. The torque relative value represents a degree of reduction in contact stress between the electrophotographic photosensitive member and the cleaning blade. As the torque relative value becomes smaller, the degree of reduction in contact stress between the electrophotographic photosensitive member and the cleaning blade becomes larger. The results are shown in the column "Initial torque relative value" in Table 12.

Subsequently, A4-size plain paper was used to continuously output an image on 7,000 sheets of the paper. A test chart having a printing ratio of 5% was used. After that, measurement of torque relative values after the 7,000-sheet repeated use was performed. The torque relative value after the 7,000-sheet repeated use was measured in the same manner as in the evaluation of the initial torque relative value. In this case, the electrophotographic photosensitive member for comparison was also subjected to the 7,000-sheet repeated use, and the resultant driving current of the rotary motor was used to calculate the torque relative value after the 7,000-sheet repeated use. The results are shown in the column "Torque relative value after 7,000-sheet repeated use" in Table 12.

<Evaluation of Matrix-domain Structure>

A section of the charge-transporting layer, obtained by cutting the charge-transporting layer in a vertical direction with respect to the electrophotographic photosensitive member produced by the above-mentioned method, was observed using an ultra-deep profile measurement microscope VK-9500 (manufactured by KEYENCE CORPORATION). In this process, an area of 100 μm×100 μm (10,000 $\mu m^2$) in the surface of the electrophotographic photosensitive member was defined as a visual field and observed at an object lens magnification of 50× to measure the maximum diameters of 100 formed domains selected at random in the visual field. An average was calculated from the measured maximum diameters and provided as a number average particle diameter. Table 12 shows the results.

Examples 2 to 107

Electrophotographic photosensitive members were each produced in the same manner as in Example 1 except that in Example 1, the resin A, polycarbonate resin D, mixing ratio between the resin A and the polycarbonate resin D, and charge-transporting substance of the charge-transporting layer were changed as shown in Table 9 or 10, and the electrophotographic photosensitive members were evaluated in the same manner as in Example 1. It was confirmed that the formed charge-transporting layer contained, in a matrix containing the charge-transporting substance and the polycarbonate resin D, a domain containing the resin A. Tables 12 and 13 show the results.

Example 108

An electrophotographic photosensitive member was produced in the same manner as in Example 1 except that in Example 1, the used solvent was changed to a mixed solvent containing 30 parts of dimethoxymethane, 50 parts of orthoxylene, and 6.4 parts of methyl benzoate, and the electrophotographic photosensitive member was evaluated in the same manner as in Example 1. It was confirmed that the formed charge-transporting layer contained, in a matrix containing the charge-transporting substances and the polycarbonate resin D, a domain containing the resin A.

Table 13 shows the results.

Comparative Examples 1 to 8

Electrophotographic photosensitive members were each produced in the same manner as in Example 1 except that in Example 1, the resin A (1) was changed to the resin H shown in Table 11. The electrophotographic photosensitive members were evaluated in the same manner as in Example 1. It was confirmed that in each of Comparative Examples 1 to 8, the formed charge-transporting layer contained, in a matrix containing the charge-transporting substances and the polycarbonate resin D, a domain containing the resin H. Table 14 shows the results.

Comparative Examples 9 to 11

Electrophotographic photosensitive members were each produced in the same manner as in Example 1 except that in Example 1, the resin A (1) and the polycarbonate resin D (1) were changed as shown in Table 11. It was confirmed that in each of Comparative Examples 9 to 11, the formed charge-transporting layer contained, in a matrix containing the charge-transporting substances and the polycarbonate resin D, a domain containing the resin A. Table 14 shows the results.

Comparative Example 12

An electrophotographic photosensitive member was produced in the same manner as in Example 1 except that in Example 1, the polycarbonate resin D (1) was not used and such a change as shown in Table 11 was performed. No matrix-domain structure was confirmed because the formed charge-transporting layer did not contain the polycarbonate resin D. The electrophotographic photosensitive member was evaluated in the same manner as in Example 1. Table 14 shows the results.

Comparative Example 13

An electrophotographic photosensitive member was produced in the same manner as in Example 1 except that in Example 1, the resin A (1) was not used and such a change as shown in Table 11 was performed. No matrix-domain structure was confirmed because the formed charge-transporting layer did not contain the resin A. The electrophotographic photosensitive member was evaluated in the same manner as in Example 1. Table 14 shows the results.

TABLE 9

| | Resin A | Polycarbonate resin D | Resin A/resin D mixing ratio | CTS |
|---|---|---|---|---|
| Example 1 | A(1) | D(1) | 3/7 | G-1/G-3 = 9/1 |
| Example 2 | A(1) | D(2) | 2/8 | G-1/G-2 = 9/1 |
| Example 3 | A(1) | D(3) | 1/9 | G-4 |
| Example 4 | A(1) | D(4) | 4/6 | G-5 |
| Example 5 | A(1) | D(5) | 3/7 | G-4/G-5 = 5/5 |
| Example 6 | A(1) | D(6) | 2/8 | G-1/G-3 = 7/3 |
| Example 7 | A(1) | D(7) | 1/9 | G-1/G-2 = 8/2 |
| Example 8 | A(1) | D(8) | 4/6 | G-1 |
| Example 9 | A(1) | D(9) | 3/7 | G-3 |
| Example 10 | A(1) | D(10) | 2/8 | G-4/G-5 = 4/6 |
| Example 11 | A(1) | D(11) | 1/9 | G-1/G-3 = 9/1 |
| Example 12 | A(1) | D(12) | 4/6 | G-1/G-2 = 9/1 |
| Example 13 | A(1) | D(13) | 3/7 | G-4 |
| Example 14 | A(1) | D(14) | 2/8 | G-5 |
| Example 15 | A(1) | D(15) | 1/9 | G-4/G-5 = 5/5 |
| Example 16 | A(1) | D(16) | 4/6 | G-1/G-3 = 7/3 |
| Example 17 | A(1) | D(17) | 3/7 | G-1/G-2 = 8/2 |
| Example 18 | A(1) | D(18) | 2/8 | G-1 |
| Example 19 | A(1) | D(19) | 1/9 | G-3 |
| Example 20 | A(1) | D(20) | 4/6 | G-4/G-5 = 4/6 |
| Example 21 | A(1) | D(21) | 3/7 | G-1/G-3 = 9/1 |
| Example 22 | A(1) | D(22) | 2/8 | G-1/G-2 = 9/1 |
| Example 23 | A(1) | D(23) | 1/9 | G-4 |
| Example 24 | A(1) | D(24) | 4/6 | G-5 |
| Example 25 | A(1) | D(25) | 3/7 | G-4/G-5 = 5/5 |
| Example 26 | A(1) | D(26) | 2/8 | G-1/G-3 = 7/3 |
| Example 27 | A(1) | D(27) | 1/9 | G-1/G-2 = 8/2 |
| Example 28 | A(1) | D(28) | 4/6 | G-1 |
| Example 29 | A(1) | D(29) | 3/7 | G-3 |
| Example 30 | A(1) | D(30) | 2/8 | G-4/G-5 = 4/6 |
| Example 31 | A(2) | D(7) | 2/8 | G-1/G-3 = 7/3 |
| Example 32 | A(3) | D(10) | 2/8 | G-1/G-3 = 7/3 |
| Example 33 | A(4) | D(13) | 2/8 | G-1/G-3 = 7/3 |
| Example 34 | A(5) | D(14) | 2/8 | G-1/G-3 = 7/3 |
| Example 35 | A(6) | D(18) | 2/8 | G-1/G-3 = 7/3 |
| Example 36 | A(7) | D(19) | 2/8 | G-1/G-3 = 7/3 |
| Example 37 | A(8) | D(20) | 2/8 | G-1/G-3 = 7/3 |
| Example 38 | A(9) | D(21) | 2/8 | G-1/G-3 = 7/3 |
| Example 39 | A(10) | D(7) | 2/8 | G-1/G-3 = 7/3 |
| Example 40 | A(11) | D(10) | 2/8 | G-1/G-3 = 7/3 |
| Example 41 | A(12) | D(13) | 2/8 | G-1/G-3 = 7/3 |

TABLE 9-continued

| | Resin A | Polycarbonate resin D | Resin A/resin D mixing ratio | CTS |
|---|---|---|---|---|
| Example 42 | A(13) | D(14) | 2/8 | G-1/G-3 = 7/3 |
| Example 43 | A(14) | D(18) | 2/8 | G-1/G-3 = 7/3 |
| Example 44 | A(15) | D(19) | 2/8 | G-1/G-3 = 7/3 |
| Example 45 | A(16) | D(20) | 2/8 | G-1/G-3 = 7/3 |
| Example 46 | A(17) | D(21) | 2/8 | G-1/G-3 = 7/3 |
| Example 47 | A(1)/A(2) = 3/1 | D(7) | 3/7 | G-1/G-3 = 7/3 |
| Example 48 | A(1)/A(2) = 7/1 | D(1)/D(10) = 5/5 | 3/7 | G-1/G-3 = 7/3 |
| Example 49 | A(1)/A(2) = 1/2 | D(21)/D(22) = 4/6 | 3/7 | G-1/G-3 = 7/3 |
| Example 50 | A(3)/A(4) = 3/1 | D(7) | 3/7 | G-1/G-3 = 7/3 |

TABLE 10

| | Resin A | Polycarbonate resin D | Resin A/resin D mixing ratio | CTS |
|---|---|---|---|---|
| Example 51 | A(20) | D(1) | 3/7 | G-1/G-3 = 9/1 |
| Example 52 | A(20) | D(2) | 2/8 | G-1/G-2 = 9/1 |
| Example 53 | A(20) | D(3) | 1/9 | G-4 |
| Example 54 | A(20) | D(4) | 4/6 | G-5 |
| Example 55 | A(20) | D(5) | 3/7 | G-4/G-5 = 5/5 |
| Example 56 | A(20) | D(6) | 2/8 | G-1/G-3 = 7/3 |
| Example 57 | A(20) | D(7) | 1/9 | G-1/G-2 = 8/2 |
| Example 58 | A(20) | D(8) | 4/6 | G-1 |
| Example 59 | A(20) | D(9) | 3/7 | G-3 |
| Example 60 | A(20) | D(10) | 2/8 | G-4/G-5 = 4/6 |
| Example 61 | A(20) | D(11) | 1/9 | G-1/G-3 = 9/1 |
| Example 62 | A(20) | D(12) | 4/6 | G-1/G-2 = 9/1 |
| Example 63 | A(20) | D(13) | 3/7 | G-4 |
| Example 64 | A(20) | D(14) | 2/8 | G-5 |
| Example 65 | A(20) | D(15) | 1/9 | G-4/G-5 = 5/5 |
| Example 66 | A(21) | D(16) | 4/6 | G-1/G-3 = 7/3 |
| Example 67 | A(21) | D(17) | 3/7 | G-1/G-2 = 8/2 |
| Example 68 | A(21) | D(18) | 2/8 | G-1 |
| Example 69 | A(21) | D(19) | 1/9 | G-3 |
| Example 70 | A(21) | D(20) | 4/6 | G-4/G-5 = 4/6 |
| Example 71 | A(21) | D(21) | 3/7 | G-1/G-3 = 9/1 |
| Example 72 | A(21) | D(22) | 2/8 | G-1/G-2 = 9/1 |
| Example 73 | A(21) | D(23) | 1/9 | G-4 |
| Example 74 | A(21) | D(24) | 4/6 | G-5 |
| Example 75 | A(21) | D(25) | 3/7 | G-4/G-5 = 5/5 |
| Example 76 | A(21) | D(26) | 2/8 | G-1/G-3 = 7/3 |
| Example 77 | A(21) | D(27) | 1/9 | G-1/G-2 = 8/2 |
| Example 78 | A(21) | D(28) | 4/6 | G-1 |
| Example 79 | A(21) | D(29) | 3/7 | G-3 |
| Example 80 | A(21) | D(30) | 2/8 | G-4/G-5 = 4/6 |
| Example 81 | A(22) | D(7) | 3/7 | G-1/G-2 = 9/1 |
| Example 82 | A(23) | D(10) | 3/7 | G-1/G-2 = 9/1 |
| Example 83 | A(24) | D(13) | 3/7 | G-1/G-2 = 9/1 |
| Example 84 | A(25) | D(14) | 3/7 | G-1/G-2 = 9/1 |
| Example 85 | A(26) | D(18) | 3/7 | G-1/G-2 = 9/1 |
| Example 86 | A(27) | D(19) | 3/7 | G-1/G-2 = 9/1 |
| Example 87 | A(28) | D(20) | 3/7 | G-1/G-2 = 9/1 |
| Example 88 | A(29) | D(21) | 3/7 | G-1/G-2 = 9/1 |
| Example 89 | A(30) | D(7) | 3/7 | G-1/G-2 = 9/1 |
| Example 90 | A(31) | D(10) | 3/7 | G-1/G-2 = 9/1 |
| Example 91 | A(32) | D(13) | 3/7 | G-1/G-2 = 9/1 |
| Example 92 | A(33) | D(14) | 3/7 | G-1/G-2 = 9/1 |
| Example 93 | A(34) | D(18) | 3/7 | G-1/G-2 = 9/1 |
| Example 94 | A(35) | D(19) | 3/7 | G-1/G-2 = 9/1 |
| Example 95 | A(36) | D(20) | 3/7 | G-1/G-2 = 9/1 |
| Example 96 | A(37) | D(21) | 3/7 | G-1/G-2 = 9/1 |
| Example 97 | A(38) | D(7) | 3/7 | G-1/G-2 = 9/1 |
| Example 98 | A(39) | D(10) | 3/7 | G-1/G-2 = 9/1 |
| Example 99 | A(40) | D(13) | 3/7 | G-1/G-2 = 9/1 |
| Example 100 | A(41) | D(14) | 3/7 | G-1/G-2 = 9/1 |
| Example 101 | A(42) | D(18) | 3/7 | G-1/G-2 = 9/1 |

TABLE 10-continued

| | Resin A | Polycarbonate resin D | Resin A/resin D mixing ratio | CTS |
|---|---|---|---|---|
| Example 102 | A(43) | D(19) | 3/7 | G-1/G-2 = 9/1 |
| Example 103 | A(44) | D(20) | 3/7 | G-1/G-2 = 9/1 |
| Example 104 | A(45) | D(21) | 3/7 | G-1/G-2 = 9/1 |
| Example 105 | A(46) | D(21) | 3/7 | G-1/G-2 = 9/1 |
| Example 106 | A(18) | D(21) | 3/7 | G-1/G-2 = 9/1 |
| Example 107 | A(19) | D(21) | 3/7 | G-1/G-2 = 9/1 |

The column "Resin A/resin D mixing ratio" in Table 9 or 10 means the mass mixing ratio of the resin A to the polycarbonate resin D. The column "CTS" represents a charge-transporting substance and means a compound represented by any one of the formulae (G-1) to (G-5).

TABLE 11

| Comparative Example | Resin H | Polycarbonate resin D | Resin H/resin D mixing ratio | CTS |
|---|---|---|---|---|
| Comparative Example 1 | H(1) | D(1) | 3/7 | G-1/G-3 = 9/1 |
| Comparative Example 2 | H(2) | D(1) | 3/7 | G-1/G-3 = 9/1 |
| Comparative Example 3 | H(3) | D(1) | 3/7 | G-1/G-3 = 9/1 |
| Comparative Example 4 | H(4) | D(1) | 3/7 | G-1/G-3 = 9/1 |
| Comparative Example 5 | H(5) | D(1) | 3/7 | G-1/G-3 = 9/1 |
| Comparative Example 6 | H(6) | D(1) | 3/7 | G-1/G-3 = 9/1 |
| Comparative Example 7 | H(7) | D(1) | 3/7 | G-1/G-3 = 9/1 |
| Comparative Example 8 | H(8) | D(1) | 3/7 | G-1/G-3 = 9/1 |
| Comparative Example 9 | A(18) | I(1) | 3/7 | G-1/G-3 = 9/1 |
| Comparative Example 10 | A(18) | I(2) | 3/7 | G-1/G-3 = 9/1 |
| Comparative Example 11 | A(18) | I(3) | 3/7 | G-1/G-3 = 9/1 |
| Comparative Example 12 | A(18) | — | — | G-1/G-3 = 9/1 |
| Comparative Example 13 | — | D(1) | — | G-1/G-3 = 9/1 |

The column "Resin H" in Table 11 means the resin H in each comparative synthesis example in Table 6 or a resin having a structural unit represented by the formula (A). The column "Polycarbonate resin D" means a resin having a structural unit represented by the formula (D) or a polycarbonate resin having the resin I in each comparative synthesis example in Table 8. The column "Resin H/resin D mixing ratio" means the mass mixing ratio of the resin H to the polycarbonate resin D. The column "CTS" represents a charge-transporting substance and means a compound represented by any one of the formulae (G-1) to (G-5).

TABLE 12

| | Initial torque relative value | Torque relative value after 7,000-sheet repeated use | Potential variation (V) | Number average particle diameter (nm) |
|---|---|---|---|---|
| Example 1 | 0.64 | 0.69 | 48 | 80 |
| Example 2 | 0.68 | 0.72 | 43 | 20 |

TABLE 12-continued

| | Initial torque relative value | Torque relative value after 7,000-sheet repeated use | Potential variation (V) | Number average particle diameter (nm) |
|---|---|---|---|---|
| Example 3 | 0.75 | 0.78 | 38 | 10 |
| Example 4 | 0.62 | 0.64 | 49 | 100 |
| Example 5 | 0.64 | 0.69 | 48 | 40 |
| Example 6 | 0.68 | 0.72 | 43 | 90 |
| Example 7 | 0.75 | 0.78 | 38 | 10 |
| Example 8 | 0.62 | 0.64 | 49 | 110 |
| Example 9 | 0.64 | 0.69 | 48 | 40 |
| Example 10 | 0.68 | 0.72 | 43 | 80 |
| Example 11 | 0.75 | 0.78 | 38 | 10 |
| Example 12 | 0.62 | 0.64 | 49 | 130 |
| Example 13 | 0.64 | 0.69 | 48 | 80 |
| Example 14 | 0.68 | 0.72 | 43 | 20 |
| Example 15 | 0.75 | 0.78 | 38 | 10 |
| Example 16 | 0.62 | 0.64 | 49 | 120 |
| Example 17 | 0.64 | 0.69 | 48 | 80 |
| Example 18 | 0.68 | 0.72 | 43 | 20 |
| Example 19 | 0.75 | 0.78 | 38 | 10 |
| Example 20 | 0.62 | 0.64 | 49 | 110 |
| Example 21 | 0.64 | 0.69 | 48 | 70 |
| Example 22 | 0.68 | 0.72 | 43 | 20 |
| Example 23 | 0.75 | 0.78 | 38 | 10 |
| Example 24 | 0.62 | 0.64 | 49 | 100 |
| Example 25 | 0.64 | 0.69 | 48 | 60 |
| Example 26 | 0.68 | 0.72 | 43 | 20 |
| Example 27 | 0.75 | 0.78 | 38 | 10 |
| Example 28 | 0.62 | 0.64 | 49 | 130 |
| Example 29 | 0.64 | 0.69 | 48 | 80 |
| Example 30 | 0.68 | 0.72 | 42 | 50 |
| Example 31 | 0.68 | 0.73 | 43 | 30 |
| Example 32 | 0.69 | 0.72 | 46 | 40 |
| Example 33 | 0.68 | 0.74 | 44 | 20 |
| Example 34 | 0.68 | 0.72 | 43 | 40 |
| Example 35 | 0.67 | 0.72 | 43 | 20 |
| Example 36 | 0.62 | 0.72 | 49 | 300 |
| Example 37 | 0.63 | 0.71 | 48 | 400 |
| Example 38 | 0.64 | 0.74 | 49 | 300 |
| Example 39 | 0.62 | 0.73 | 47 | 400 |
| Example 40 | 0.59 | 0.72 | 54 | 600 |
| Example 41 | 0.58 | 0.71 | 53 | 500 |
| Example 42 | 0.68 | 0.73 | 43 | 20 |
| Example 43 | 0.69 | 0.73 | 45 | 20 |
| Example 44 | 0.68 | 0.72 | 43 | 20 |
| Example 45 | 0.75 | 0.78 | 38 | 10 |
| Example 46 | 0.62 | 0.64 | 47 | 400 |
| Example 47 | 0.64 | 0.69 | 48 | 40 |
| Example 48 | 0.63 | 0.68 | 47 | 40 |
| Example 49 | 0.62 | 0.67 | 49 | 40 |
| Example 50 | 0.64 | 0.69 | 48 | 40 |

TABLE 13

| | Initial torque relative value | Torque relative value after 7,000-sheet repeated use | Potential variation (V) | Number average particle diameter (nm) |
|---|---|---|---|---|
| Example 51 | 0.64 | 0.74 | 56 | 400 |
| Example 52 | 0.68 | 0.78 | 54 | 300 |
| Example 53 | 0.75 | 0.81 | 45 | 400 |
| Example 54 | 0.62 | 0.65 | 59 | 300 |
| Example 55 | 0.64 | 0.74 | 56 | 400 |
| Example 56 | 0.68 | 0.78 | 54 | 300 |
| Example 57 | 0.75 | 0.81 | 45 | 400 |
| Example 58 | 0.62 | 0.65 | 59 | 300 |
| Example 59 | 0.64 | 0.74 | 56 | 400 |
| Example 60 | 0.68 | 0.78 | 54 | 300 |
| Example 61 | 0.75 | 0.81 | 45 | 400 |
| Example 62 | 0.62 | 0.65 | 59 | 300 |
| Example 63 | 0.64 | 0.74 | 56 | 400 |
| Example 64 | 0.68 | 0.78 | 54 | 300 |

TABLE 13-continued

| | Initial torque relative value | Torque relative value after 7,000-sheet repeated use | Potential variation (V) | Number average particle diameter (nm) |
|---|---|---|---|---|
| Example 65 | 0.75 | 0.81 | 45 | 400 |
| Example 66 | 0.54 | 0.71 | 68 | 700 |
| Example 67 | 0.58 | 0.73 | 62 | 800 |
| Example 68 | 0.63 | 0.76 | 57 | 700 |
| Example 69 | 0.68 | 0.81 | 53 | 800 |
| Example 70 | 0.54 | 0.71 | 68 | 700 |
| Example 71 | 0.58 | 0.73 | 62 | 800 |
| Example 72 | 0.63 | 0.76 | 57 | 700 |
| Example 73 | 0.68 | 0.81 | 53 | 800 |
| Example 74 | 0.54 | 0.71 | 68 | 700 |
| Example 75 | 0.58 | 0.73 | 62 | 800 |
| Example 76 | 0.63 | 0.76 | 57 | 700 |
| Example 77 | 0.68 | 0.81 | 53 | 800 |
| Example 78 | 0.54 | 0.71 | 68 | 700 |
| Example 79 | 0.58 | 0.73 | 62 | 800 |
| Example 80 | 0.63 | 0.76 | 57 | 700 |
| Example 81 | 0.64 | 0.72 | 56 | 300 |
| Example 82 | 0.58 | 0.73 | 62 | 800 |
| Example 83 | 0.59 | 0.69 | 61 | 700 |
| Example 84 | 0.52 | 0.68 | 69 | 1,000 |
| Example 85 | 0.71 | 0.72 | 49 | 100 |
| Example 86 | 0.64 | 0.71 | 56 | 300 |
| Example 87 | 0.58 | 0.72 | 63 | 700 |
| Example 88 | 0.59 | 0.73 | 62 | 800 |
| Example 89 | 0.58 | 0.71 | 61 | 700 |
| Example 90 | 0.59 | 0.74 | 64 | 700 |
| Example 91 | 0.64 | 0.73 | 56 | 300 |
| Example 92 | 0.63 | 0.71 | 57 | 400 |
| Example 93 | 0.62 | 0.72 | 55 | 300 |
| Example 94 | 0.63 | 0.73 | 58 | 400 |
| Example 95 | 0.58 | 0.71 | 62 | 700 |
| Example 96 | 0.59 | 0.74 | 61 | 800 |
| Example 97 | 0.57 | 0.73 | 64 | 700 |
| Example 98 | 0.64 | 0.71 | 56 | 300 |
| Example 99 | 0.63 | 0.72 | 57 | 400 |
| Example 100 | 0.62 | 0.73 | 55 | 300 |
| Example 101 | 0.63 | 0.78 | 58 | 300 |
| Example 102 | 0.64 | 0.74 | 56 | 400 |
| Example 103 | 0.63 | 0.73 | 57 | 400 |
| Example 104 | 0.62 | 0.71 | 55 | 300 |
| Example 105 | 0.58 | 0.74 | 63 | 700 |
| Example 106 | 0.59 | 0.68 | 62 | 800 |
| Example 107 | 0.63 | 0.67 | 58 | 300 |
| Example 108 | 0.52 | 0.62 | 38 | 50 |

TABLE 14

| | Initial torque relative value | Torque relative value after 7,000-sheet repeated use | Potential variation (V) | Number average particle diameter (nm) |
|---|---|---|---|---|
| Comparative Example 1 | 0.51 | 0.71 | 111 | 1,800 |
| Comparative Example 2 | 0.92 | 0.72 | 59 | 300 |
| Comparative Example 3 | 0.59 | 0.92 | 62 | 700 |
| Comparative Example 4 | 0.74 | 0.77 | 95 | 1,500 |
| Comparative Example 5 | 0.53 | 0.71 | 110 | 2,000 |
| Comparative Example 6 | 0.61 | 0.86 | 70 | 300 |
| Comparative Example 7 | 0.52 | 0.87 | 71 | 500 |
| Comparative Example 8 | 0.65 | 0.92 | 82 | 700 |
| Comparative Example 9 | 0.63 | 0.66 | 95 | 1,600 |

TABLE 14-continued

| | Initial torque relative value | Torque relative value after 7,000-sheet repeated use | Potential variation (V) | Number average particle diameter (nm) |
|---|---|---|---|---|
| Comparative Example 10 | 0.62 | 0.67 | 110 | 1,800 |
| Comparative Example 11 | 0.63 | 0.68 | 122 | 2,200 |
| Comparative Example 12 | 0.64 | 0.66 | 132 | — |
| Comparative Example 13 | 1.00 | 1.00 | 39 | — |

Comparison between Examples 1 to 108 and Comparative Examples 1 to 13 shows that in each of Examples, the charge-transporting layer contains the resin A and the polycarbonate resin D, and hence both the suppressing effect on the potential variation and the sustainable relaxing effect on the contact stress are achieved. The foregoing is demonstrated by the potential variation of the evaluation methods, and the presence of torque-reducing effects in the evaluation at the initial stage and the evaluation after the 7,000-sheet repeated use.

Comparison between Examples 1 to 108 and Comparative Examples 9 to 11 shows that the incorporation of the structural unit represented by the formula (D) into the polycarbonate resin D of the present application exhibits the suppressing effect on the potential variation. This is probably because a uniform matrix-domain structure is formed and hence the localization of the siloxane resin toward the interface is suppressed.

When the polycarbonate resin D contains the structural unit represented by the formula (D), an excellent suppressing effect on the potential variation and an excellent torque-reducing effect are observed as long as the resin A specified in the present invention is used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-064088, filed Mar. 26, 2014, and Japanese Patent Application No. 2015-026689, filed Feb. 13, 2015, which are hereby incorporated by reference herein in their entirety.

What is claimed is:

1. An electrophotographic photosensitive member, comprising:

a support;

a charge-generating layer on the support; and a charge-transporting layer on the charge-generating layer, the charge-transporting layer being a surface layer of the electrophotographic photosensitive member and comprising a matrix-domain structure comprising a domain and a matrix, wherein the domain includes a resin A having a siloxane structure represented by the following formula (A-E) at an end thereof:

(A-E)

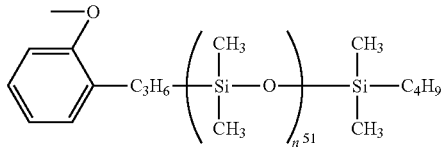

in the formula (A-E), an average of $n^{51}$ in the formula (A-E) ranges from 10 to 60, said resin A comprising:

a structural unit represented by one of the following formulae (A-1) and (A-2); and a structural unit represented by the following formula (B), the matrix includes a charge-transporting substance and a polycarbonate resin D, polycarbonate resin D comprising a structural unit represented by the following formula (D) and a structural unit represented by the following formula (E), a content of the structural unit represented by one of the formulae (A-1) and (A-2) in the resin A is from 5% by mass to 25% by mass based on a total mass of the resin A, a content of the structural unit represented by the formula (B) in the resin A is from 25% by mass to 95% by mass based on the total mass of the resin A, a content of the structural unit represented by the formula (D) in the polycarbonate resin D is from 10% by mass to 60% by mass based on a total mass of the polycarbonate resin D, and a content of the structural unit represented by the formula (E) in the polycarbonate resin D is from 40% by mass to 90% by mass based on the total mass of the polycarbonate resin D;

(A-1)

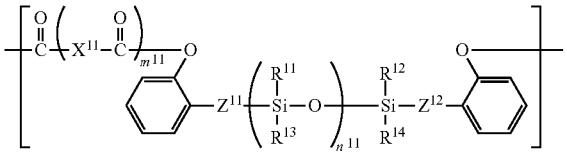

in the formula (A-1):

$m^{11}$ represents 0 or 1;

when $m^{11}$ represents 1, $X^{11}$ represents an o-phenylene group, a m-phenylene group, a p-phenylene group, a bivalent group having two p-phenylene groups bonded with a methylene group, or a bivalent group having two p-phenylene groups bonded with an oxygen atom;

$Z^{11}$ and $Z^{12}$ each independently represent an alkylene group having 1 to 4 carbon atoms;

$R^{11}$ to $R^{14}$ each independently represent an alkyl group having 1 to 4 carbon atoms, or a phenyl group; and $n^{11}$ represents a number of repetitions of a structure within parentheses, and an average of $n^{11}$ in the formula (A-1) ranges from 10 to 150;

(A-2)

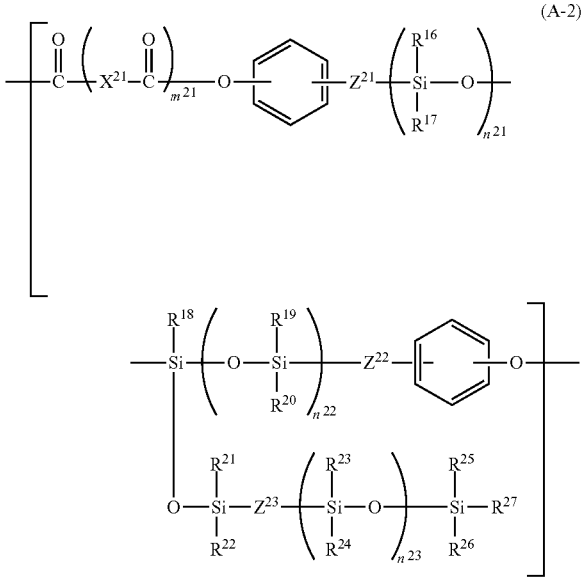

in the formula (A-2):

$m^{21}$ represents 0 or 1;

when $m^{21}$ represents 1, $X^{21}$ represents an o-phenylene group, a m-phenylene group, a p-phenylene group, a bivalent group having two p-phenylene groups bonded with a methylene group, or a bivalent group having two p-phenylene groups bonded with an oxygen atom;

$Z^{21}$ to $Z^{23}$ each independently represent an alkylene group having 1 to 4 carbon atoms;

$R^{16}$ to $R^{27}$ each independently represent an alkyl group having 1 to 4 carbon atoms, or a phenyl group; and $n^{21}$, $n^{22}$, $n^{23}$ each independently represent a number of repetitions of a structure within parentheses, an average of $n^{21}$ and an average of $n^{22}$ in the formula (A-2) each range from 1 to 10, and an average of $n^{23}$ in the formula (A-2) ranges from 10 to 200;

(B)

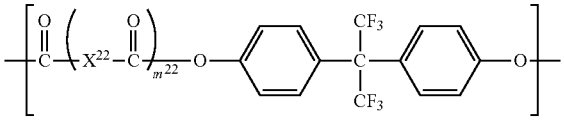

in the formula (B):

$m^{22}$ represents 0 or 1; and when $m^{22}$ represents 1, $X^{22}$ represents an o-phenylene group, a m-phenylene group, a p-phenylene group, a bivalent group having two p-phenylene groups bonded with a methylene group, or a bivalent group having two p-phenylene groups bonded with an oxygen atom;

(D)

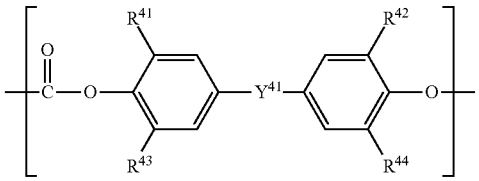

in the formula (D):

$Y^{41}$ represents an oxygen atom or a sulfur atom; and $R^{41}$ to $R^{44}$ each independently represent a hydrogen atom or a methyl group;

(E)

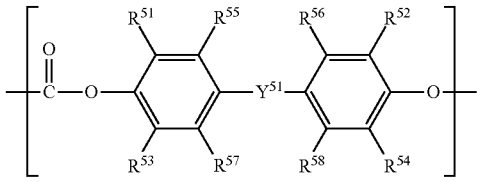

in the formula (E):

$Y^{51}$ represents a single bond, a methylene group, an ethylidene group, a propylidene group, a cyclohexylidene group, a phenylethylidene group, or a phenylmethylene group; and, $R^{51}$ to $R^{58}$ each independently represent a hydrogen atom or a methyl group, wherein resin A does not comprise the structural unit represented by formula (D).

2. An electrophotographic photosensitive member according to claim 1, wherein:

the resin A further comprises a structural unit represented by the following formula (C);

the content of the structural unit represented by one of the formulae (A-1) and (A-2) is from 5% by mass to 25% by mass based on the total mass of the resin A;

the content of the structural unit represented by the formula (B) is from 35% by mass to 65% by mass based on the total mass of the resin A; and a content of the structural unit represented by the formula (C) is from 10% by mass to 60% by mass based on the total mass of the resin A:

(C)

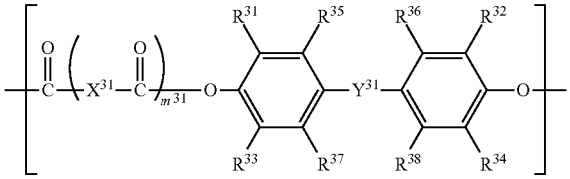

in the formula (C):

$m^{31}$ represents 0 or 1;

when $m^{31}$ represents 1, $X^{31}$ represents an o-phenylene group, a m-phenylene group, a p-phenylene group, a bivalent group having two p-phenylene groups bonded with a methylene group, or a bivalent group having two p-phenylene groups bonded with an oxygen atom;

$Y^{31}$ represents an oxygen atom or a sulfur atom; and $R^{31}$ to $R^{38}$ each independently represent a hydrogen atom or a methyl group.

3. An electrophotographic photosensitive member according to claim 2, wherein:

the resin A further comprises a structural unit represented by the following formula (F);

the content of the structural unit represented by one of the formulae (A-1) and (A-2) is from 5% by mass to 25% by mass based on the total mass of the resin A;

the content of the structural unit represented by the formula (B) is from 35% by mass to 65% by mass based on the total mass of the resin A;

the content of the structural unit represented by the formula (C) is from 10% by mass to 60% by mass based on the total mass of the resin A; and a content of the structural unit represented by the formula (F) is 30% by mass or less based on the total mass of the resin A:

(F)

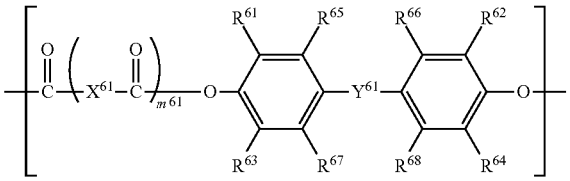

in the formula (F):

$m^{61}$ represents 0 or 1;

when $m^{61}$ represents 1, $X^{61}$ represents an o-phenylene group, a m-phenylene group, a p-phenylene group, a bivalent group having two p-phenylene groups bonded with a methylene group, or a bivalent group having two p-phenylene groups bonded with an oxygen atom;

$Y^{61}$ represents a single bond, a methylene group, an ethylidene group, a propylidene group, a cyclohexylidene group, a phenylethylidene group, or a phenylmethylene group; and $R^{61}$ to $R^{68}$ each independently represent a hydrogen atom or a methyl group.

4. An electrophotographic photosensitive member according to claim 1, wherein a content of the resin A is from 5% by mass to 50% by mass based on a total mass of whole resins in the charge-transporting layer.

5. An electrophotographic photosensitive member according to claim 1, wherein the domain has a number average particle diameter of from 10 nm to 1,000 nm.

6. An electrophotographic photosensitive member according to claim 1, wherein the charge-transporting substance comprises at least one compound selected from the group consisting of a triarylamine compound, a hydrazone compound, a butadiene compound, and an enamine compound.

7. A process cartridge, comprising:

the electrophotographic photosensitive member of claim 1; and at least one unit selected from the group consisting of a charging unit, a developing unit, a transfer unit, and a cleaning unit, wherein the member and the unit are supported integrally, and the process cartridge is removably mounted onto an electrophotographic apparatus body.

8. An electrophotographic apparatus, comprising:

the electrophotographic photosensitive member of claim 1;

a charging unit;

an exposing unit;

a developing unit; and a transfer unit.

* * * * *